US008720197B2

(12) United States Patent
Persson et al.

(10) Patent No.: US 8,720,197 B2
(45) Date of Patent: May 13, 2014

(54) FLOW MANAGEMENT SYSTEM FOR HYDRAULIC WORK MACHINE

(75) Inventors: Bengt-Goran Persson, Sandared (SE); Dale Vanderlaan, Waxhaw, NC (US); Lew Kasper, Poland, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 925 days.

(21) Appl. No.: 12/867,367

(22) PCT Filed: Feb. 11, 2009

(86) PCT No.: PCT/US2009/033720

§ 371 (c)(1), (2), (4) Date: Aug. 12, 2010

(87) PCT Pub. No.: WO2009/102740

PCT Pub. Date: Aug. 20, 2009

(65) Prior Publication Data

US 2011/0030364 A1 Feb. 10, 2011

Related U.S. Application Data

(60) Provisional application No. 61/028,004, filed on Feb. 12, 2008.

(51) Int. Cl.
*F15B 21/08* (2006.01)

(52) U.S. Cl.
USPC ..... 60/488; 60/456; 60/476

(58) Field of Classification Search
USPC ..... 60/456, 473, 475, 476, 486, 488
See application file for complete search history.

(56) References Cited

U.S. PATENT DOCUMENTS

| | | | | | |
|---|---|---|---|---|---|
| 4,369,625 | A | * | 1/1983 | Izumi et al. | 60/327 |
| 4,395,878 | A | * | 8/1983 | Morita et al. | 60/427 |
| 5,109,672 | A | * | 5/1992 | Chenoweth et al. | 60/456 |
| 5,144,801 | A | | 9/1992 | Scanderbeg et al. | |
| 5,778,671 | A | * | 7/1998 | Bloomquist et al. | 60/456 |
| 5,819,536 | A | * | 10/1998 | Mentink | 60/464 |

(Continued)

FOREIGN PATENT DOCUMENTS

| | | | | |
|---|---|---|---|---|
| JP | 2001-002371 | | 1/2001 | |
| JP | 2001002371 | A * | 1/2001 | B66C 13/20 |

OTHER PUBLICATIONS

International Search Report and Written Opinion of corresponding International Application No. PCT/US2009/033720, dated Sep. 2, 2009.

(Continued)

*Primary Examiner* — Thomas E Lazo
(74) *Attorney, Agent, or Firm* — Renner, Otto, Boisselle & Sklar, LLP

(57) ABSTRACT

A flow management system capable of providing adjustable hydraulic fluid flow or pressure at a common line to supply bidirectional pumps in electro-hydrostatic actuation systems and conditioning re-circulated hydraulic fluid. The system enables flow sharing between multiple actuation systems and minimization of energy consumption by a power-on-demand approach and/or electrical energy regeneration while eliminating the need for an accumulator. The system has particular application to electro-hydrostatic actuation systems that typically include bi-directional electric motor driven pumps and unbalanced hydraulic actuators connected within closed circuits to provide work output against external loads and reversely recover energy from externally applied loads.

24 Claims, 11 Drawing Sheets

(56) References Cited

U.S. PATENT DOCUMENTS

| | | | | |
|---|---|---|---|---|
| 5,937,646 | A * | 8/1999 | Zakula | 60/430 |
| 6,912,849 | B2 | 7/2005 | Inoue et al. | |
| 6,962,050 | B2 * | 11/2005 | Hiraki et al. | 60/414 |
| 7,578,127 | B2 * | 8/2009 | Griswold | 60/422 |

OTHER PUBLICATIONS

International Preliminary Report on Patentability of corresponding International Application No. PCT/US2009/033720, dated Jun. 2, 2010.

* cited by examiner

FLOW MANAGEMENT SYSTEM FOR HYDRAULIC WORK MACHINE

RELATED APPLICATION DATA

This application is a national phase of International Application No. PCT/US2009/033720 filed Feb. 11, 2009 and published in the English language, which claims priority of U.S. Provisional Application No. 61/028,004 filed Feb. 12, 2008, which are hereby incorporated herein by reference in their entirety.

FIELD OF THE INVENTION

The invention relates generally to hydraulic actuation systems for extending and retracting at least one unbalanced hydraulic cylinder in a work machine, such as but not limited to hydraulic excavators, wheel loaders, loading shovels, backhoe shovels, mining equipment, industrial machinery and the like, having one or more actuated components such as lifting and/or tilting arms, booms, buckets, steering and turning functions, traveling means, etc. The invention has particular application to closed circuit electro-hydrostatic actuation systems requiring elevated inlet hydraulic fluid pressure and improved hydraulic fluid conditioning.

BACKGROUND OF THE INVENTION

In a typical unbalanced (differential) hydraulic cylinder, the cross-sectional area of the chamber on the head side of the piston is greater than the cross-sectional area of the chamber on the rod side of the piston. When the cylinder is extended, more fluid is needed to fill the head-end or extend chamber of the cylinder than is being discharged from the rod-end or retract chamber. Conversely, less fluid is needed to fill the rod-end chamber than is being discharged from the head-end chamber when the cylinder is being retracted.

In modern machinery using electro-hydrostatic actuation (EHA) systems it may by advantageous to locate the electric motor driven pumps and hydraulic actuators in areas remote from the tank or reservoir. This distance increases the likelihood of cavitation and associated pitting occurring in the hydraulic pumps and associated control valves as the hydraulic fluid is exposed to sharp and rapid pressure drops resulting from the demands of highly responsive actuators. To prevent vacuum and associated cavitation in the lines, pumps and valves leading to the inlet side of the actuation system pumps, it is desirable to provide and maintain an elevated pressure in the hydraulic passages leading from the tank or reservoir to the actuation system pump inlet. This is accomplished in prior art by the installation of one or more pressurized accumulators in a closed hydraulic circuit and in communication with the inlet or low pressure passages leading to each pump of the EHA system(s) and thereby maintaining adequate hydraulic fluid pressure during all actuation activities. The pressurized accumulator is typically of a bladder type having a gas pressure charged volume separated from the hydraulic fluid by a flexible membrane or bladder or alternately of a metal bellows or spring loaded piston type.

As the result of the addition of a pressurized accumulator in closed circuit communication with the EHA system, several disadvantages are incurred. The amount of hydraulic fluid in the accumulator must exceed that which is rejected by all contracted cylinders in closed circuit with it by allowances for thermal expansion and contraction of all of the hydraulic fluid in the system, hydraulic fluid leakage and the included volume of the gas chamber. As a result, the physical size and weight of the accumulator is undesirably large. Also, since some of the hydraulic fluid contained in the accumulator is not circulated to and from a tank or reservoir that is open to the atmosphere, entrained air bubbles are not allowed to escape from the accumulator. This problem may be compounded if gas leakage should occur across the accumulator bladder. Also, gas charged accumulators require added maintenance due to the need for a gas charging means. There is also the threat of external nuisance gas and hydraulic fluid leakage during storage since at least a part of the system remains under pressure at all times.

An exemplary prior art system for controlling an unbalanced hydraulic cylinder 20 is illustrated at 21 in FIG. 1. The system 21 provides for flow management between a two port pump 23 and the unbalanced hydraulic cylinder 20. The pump 23 is of a bi-directional type that is continuously driven in one direction by an electric motor or other drive means. The pump has one inlet/outlet port 26 connected by a line 27 to the extend chamber 28 of the hydraulic cylinder 20 and the other inlet/outlet port 30 connected by a line 31 to the retract chamber 32 of the hydraulic cylinder. The displacement of the pump is controlled by a control valve 35, which in the case of a piston-type pump controls the tilt of the swash plate that in turn controls the flow direction and displacement of the pump. The position of the control valve 35 is determined by a directional valve 36 that selectively connects the outlet 37 of a charge pump 38 via line 40 to either side of the control valve and the opposite side to a system tank or reservoir 41 via line 42. The charge pump 38 is continuously driven at the same speed and in the same direction as the pump 23. Much of the output of the charge pump is dumped across a relief valve 44, with consequent heat generation and energy loss.

For flow management of the unbalanced hydraulic cylinder 20, the lines 27 and 31 are connected by respective pilot-operated check valves 46 and 47 to a common line 48 connected between the outlet 37 of the charge pump 38 and an accumulator 50. In this type of pump, both the accumulator and charge pump are needed to support supply pressure and flow requirements. The accumulator supports the charge pump to keep the inlet pressure to the pump 23 at an elevated level during high accumulator demands to avoid cavitation during fast acceleration of the pump. The pressure on common line 48 is determined by the accumulator or an adjustable pressure relief valve 44 connected between the common line 48 and the tank 41. The adjustable pressure relief valve 44 or accumulator 50 also determines the pressure supplied to the directional valve 36 for operating the control valve 35. The illustrated prior art system further includes adjustable pressure relief valves 52 and 53 respectively connecting lines 27 and 31 to the common line. The pressure relief valves 52 and 53 protect the pump and cylinder from the possibility of over pressurization in the event that an excessive external overload on the cylinder should be applied when the pump is in a neutral position preventing relief of a high pressure in line 27 or 31.

In operation, the valve 36 may be controlled to cause the pump 23 to supply hydraulic fluid to the line 27 for extending the hydraulic cylinder 20. Flow leaving the hydraulic cylinder will flow to back to the pump. Because of the cylinder unbalance, such flow will be less than the volume of flow being supplied to the extend side of the cylinder. This will cause the pressure on line 31 to drop below the pressure on common line 48, whereupon make-up flow can be provided from the accumulator 50 and/or from the tank 41 via the charge pump 38. At this time, pressure supplied by pilot line 54 from line 27 will have caused the pilot-operated check valve 47 to have opened.

When the pump 23 is operated in the reverse direction, there will be an excess volume of fluid leaving the cylinder 20. This excess flow will be diverted to the common line 48 by the pilot-operated check valve 46 that will then be open by pilot pressure supplied from the line 31 via pilot line 56.

FIG. 2 shows another prior art system 60 that uses two bidirectional pumps 61 and 62 and a piston-type variable pressure accumulator 63. The accumulator pressure can be raised or lowered by an electrically powered actuator 64 to increase control flexibility. An elevated pressure would be used, for instance, for normal electro-hydraulic actuator (EHA) operation. A lowered pressure might be used when retracting the cylinder 66. The system also includes a pump 68 that is continuously driven by an engine, electric motor, or the like. A switching valve 69 either supplies hydraulic fluid from the pump 68 to replenish leakage and charge the accumulator 63 or re-circulates hydraulic fluid back to the tank (reservoir) 71 with an associated heat loss. Reference may be had to U.S. Pat. No. 6,962,050 for further details of an exemplary system of the type shown in FIG. 2.

FIG. 3 shows still another prior art system 90 using closed circuit flow management. The system 90 utilizes what is commonly referred to as a three-port pump 91, such as shown in U.S. Pat. Nos. 5,144,801 and 6,912,849. The three-port pump is designed such that an internal porting arrangement within the pump provides a division of flow in proportion to the cylinder head end and cylinder rod side annular areas. When the cylinder 94 is extending, for example, the volumetric output of the pump flowing into the cylinder head end 95 at an elevated pressure is equal to the sum of hydraulic fluid taken into the pump at a reduced pressure from the cylinder rod side 96 plus the necessary make up hydraulic fluid provided by a low pressure accumulator 97. Conversely, when the cylinder is retracting, the volumetric flow at a reduced pressure flowing from the cylinder head end 95 and into the pump 91 is equal to the sum of hydraulic fluid at an increased pressure flowing to the cylinder rod end side 96 plus an excess of hydraulic fluid expelled into the low pressure accumulator 97.

In excavating equipment and other working machines, large liquid-cooled motors have been used to drive the pumps used to hydraulically power the functional cylinders. Accordingly, a liquid cooling system heretofore has been needed to maintain the operating temperature of the motors and associated electronic power modules at an acceptable operating temperature. The flow management and temperature control systems heretofore employed have been inefficient, expensive and/or complicated.

SUMMARY OF THE INVENTION

The present invention provides an improved flow management system for electro-hydraulic actuator systems that affords one or more advantages heretofore not attainable by prior art flow management system.

The invention has particular application to working machines utilizing electro-hydrostatic actuation with unbalanced cylinders that desirably have a boosted inlet hydraulic fluid supply capable of maintaining a suitably elevated pressure at the actuation system pump inlet under all dynamic activities demanded by the working machine. In this way, aeration, cavitation and associated destructive pitting of component parts which may result from exposure to a vacuum or sharp and rapid pressure changes, can be substantially reduced if not eliminated.

The invention also has particular application to working machines utilizing a plurality of unbalanced cylinders and enables the management of flow with a minimum number of electro-hydraulic components including, for instance, only a single electric motor driven boost pump and excluding the use of undesirable accumulators. According to one aspect of the invention, the boost pump supplies hydraulic fluid flow at a nearly constant elevated pressure to all of the EHA systems, which systems may be remotely located away from the boost system and reservoir. In a preferred arrangement, hydraulic fluid is returned to the flow management system from one of the EHA systems, for example, to be immediately used by another EHA system without having to be returned to the reservoir, thereby eliminating losses associated with the return of hydraulic fluid to the reservoir.

According to another aspect of the invention, a flow management system includes a computer controller to control boost pump motor speed and/or output torque so as to maintain a desired boost system pressure. A motor power electronic controller may be used to amplify low power control signals from the computer controller into high power electric motor commands.

The boost system pump can be intermittently driven only as needed to accomplish work output. Also, the boost system may be configured such that when used in an application having multiple actuation systems, low side cylinder return flow is regularly distributed to and used by adjacent systems rather than being returned to the reservoir. Any un-needed flow may be returned to the reservoir through a heat exchanger and at a reduced pressure (lowered relief valve setting) to minimize heat lost loss.

A variable pressure relief valve may be used to allow the boost pressure to be reduced or increased as commanded by the controller. The relief valve may increase the boost pressure level when flow is delivered to the electro-hydraulic functional systems and reduce the boost pressure when flow is returned to the reservoir.

Generally, the maximum commanded motor torque may limit the maximum boost pressure level that can be developed by the pump. The variable pressure relief valve maximum value may be set higher than the maximum pump pressure level as limited by pump torque, so as to act as a high pressure safety relief valve to protect hydraulic components of the boost system, should the boost pressure level rise above the pump driven maximum.

Additionally, a check valve may be installed at the pump outlet to prevent reverse flow and to protect the pump from possible high pressure line surges.

A low pressure relief valve setting as determined by the controller may be used when hydraulic fluid is to be returned to the reservoir.

According to a further aspect of the invention, a dump valve may, in general, be used to allow hydraulic fluid to flow freely with minimum resistance to the reservoir. The dump valve may be opened when it is desirable under certain operating conditions (such as the rapid lowering of a boom or arm of an implement) to retract an actuator as quickly as possible. Additionally, the dump valve may be opened to drop the EHA system pressure as low as possible during storage thereby eliminating the threat of prolonged external leakage.

According to still another aspect of the invention, provision is made for determining whether flow is to be delivered to an actuation system (net positive flow) or is to be returned to the reservoir (net negative flow). In a preferred implementation, the boost pump responds ahead of and faster than the actuation pump so as to anticipate boost flow and pressure needs thereby to avoid cavitation between the two pumps.

According to a still further aspect of the invention, a flow management system may have a boost pump capable of being reversely driven and a motor that acts as a generator when reversely driven so as to recover energy by electrical regeneration when hydraulic fluid is returned to the reservoir. This provides a way of recovering additional energy that would otherwise be wasted and returning it to a capacitor or storage battery.

The invention in one or more of its various implementations enables the performance of one or more functions, particularly in a closed system, that would otherwise be difficult if not impossible to achieve with a system using an accumulator. Systems that use accumulators have significant disadvantages including added size and weight, the threat of external hydraulic fluid leakage and external and internal gas leakage, gas charge maintenance issues, require a hydraulic fluid charge pump, and increased manufacturing and inventory costs. The one or more functions enabled by one or more aspects of the invention include the following:

a. To provide a means of cooling the EHA motor/generators and power electronics by recirculation of a controlled amount of cool hydraulic fluid supplied by the boost pump and thereby eliminate the need for an additional pump specifically or partially for this purpose.

b. To provide an un-pressurized reservoir for hydraulic fluid storage (as opposed to an accumulator), for the acceptance of pump case drain hydraulic fluid and to provide the lowest possible reference for increased actuator dynamics (such as fast actuator retraction) and reduced energy losses. A low pump case pressure extends shaft seal life. Additionally the un-pressurized reservoir permits entrained air to escape on a continuing basis.

c. To provide filtration of the hydraulic fluid that is returned to the reservoir.

The invention in one or more of its various implementations also enables the performance of one or more additional functions in a closed system that would otherwise be difficult if not impossible to achieve in prior art systems. These functions include the following:

a. To provide for and manage the cooling of hydraulic fluid by the controlled recirculation through a heat exchanger.

b. To provide for and manage the warm up of hydraulic fluid during start up after storage in a cold environment by recirculation across the variable pressure relief valve.

Accordingly, the invention provides a hydraulic system with hydraulic fluid flow management, comprising at least one actuator system, a boost system for accepting or supplying fluid from or to the at least one actuator system, and a controller. The actuator system includes a hydraulic actuator to and from which hydraulic fluid is supplied and returned in opposite directions to operate the actuator in opposite directions, a bi-directional pump operable in one direction for supplying pressurized fluid from a first inlet/outlet port to the hydraulic actuator for operating the actuator in one direction, and operable in a second direction opposite the first direction for supplying pressurized fluid from a second inlet/outlet port to the hydraulic actuator for operating the actuator in a direction opposite the first direction, and an electric bi-directional pump drive for driving the bi-directional pump in either direction. The boost system includes a boost pump for supplying fluid to a fluid make-up/return line that selectively is in fluid communication with one of the inlet/outlet ports of the bi-directional pump when the other of the inlet/output ports is supplying pressurized fluid to the hydraulic actuator, and an electric boost pump drive for driving the boost pump. The controller includes at least one logic device for controlling operation of the electric bi-directional pump drive and the boost pump drive, the logic device controlling the boost pump drive being configured to control operation of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

In the various implementations of the invention, the logic device may be configured to control operation of the boost pump drive in anticipation of the pressure or flow demands arising from commands controlling operation of the bi-directional pump drive.

Alternatively or additionally, the boost system may include a pressure relief valve for limiting the pressure in the make-up/return line to less than the pressure of the pressurized fluid being supplied to the actuator. The pressure relief valve or a dump valve may be selectively operable by the controller to connect the make-up/return line to a hydraulic fluid reservoir such that the pressure at the make-up/return line will be rapidly reduced to facilitate acceptance of fluid from the actuator system. In some embodiments, the dump valve may be connected in parallel with the pressure relief valve between the make-up/return line and the reservoir, that may be unpressurized.

In many applications the hydraulic system may include a plurality of actuator systems, and the make-up/return line may be common to the plurality of actuator systems, while the boost pump drive is controlled on the basis of the net hydraulic fluid make-up flow or pressure demand of the plurality of actuator systems. The boost system may also be controlled to dump to reservoir net excess return fluid received from the plurality of actuators.

The system may also include for energy recovery an electrical energy storage device, and the boost pump drive may be reversely driven by flow through the pump from the make-up/return line to the reservoir to generate electrical energy for storage in the electrical energy storage device.

In some applications, hydraulic fluid from the make-up return line may be circulated through a heat exchanger and at least a part of one of the pump drives, and in particular through power circuitry that supplies power to the pump motor when commanded by the controller, thereby to cool the power circuitry.

According to another aspect of the invention, a hydraulic system comprises an actuator system for extending and retracting a respective unbalanced hydraulic cylinder having a head-end chamber and a rod-end chamber, and a boost system for reliably and automatically supplying or accepting differential flow from cylinder. The actuator system comprises first and second fluid flow lines respectively connectable to the head-end and rod-end chambers of the hydraulic cylinder; a bi-directional pump having and a valve assembly. The bi-directional pump has first and second inlet/outlet ports respectively connected to the first and second fluid flow lines whereby operation of the pump in a first direction will supply pressurized fluid to the first fluid flow line for delivery to the head-end chamber of the hydraulic cylinder while drawing fluid through the second fluid flow line from the rod-end of the cylinder, and operation of the pump in a second direction opposite the first direction will supply pressurized fluid to the second fluid flow line for delivery to the rod-end chamber of the hydraulic cylinder while drawing fluid through the first fluid flow line from the head-end of the cylinder. The valve assembly is connected between the first and second fluid flow lines and a third fluid flow line. The valve assembly is operated by differential pressure between the first and second fluid flow lines to connect the second fluid flow line to the third fluid flow line when pressure in the first fluid flow line exceeds the pressure in the second fluid flow line by a prescribed amount whereby make-up fluid can be supplied through the third fluid flow line to the second fluid flow line, and to connect the first fluid flow line to the third fluid flow line when pressure in the second fluid flow line exceeds the pressure in the first fluid flow line by a prescribed amount whereby excess fluid from the head-end chamber of the hydraulic cylinder can be accepted by the third fluid flow line. The boost system, which accepts or supplies fluid from or to the third fluid flow line, includes a boost pump for supplying pressurized fluid to the third fluid flow line at a pressure normally less than the pressure at which fluid is supplied to the first and second fluid flow lines by the bi-directional pump.

In a preferred embodiment, the valve assembly includes a pilot-operated, three-position valve having pilot ports respectively connected to the first and second fluid flow lines.

Optionally or additionally, a first pressure relief valve may be connected between the first fluid flow line and the boost system, and a second pressure relief valve is connected between the first fluid flow line and the third fluid flow line.

Optionally or additionally, the boost pump may have an inlet for drawing fluid from a reservoir and an outlet connected by the third fluid flow line to the valve assembly for supplying pressurized fluid to the third flow line at a pressure normally less than the pressure at which fluid is supplied to the first and second fluid flow lines by the bi-directional pump.

Optionally or additionally, the bidirectional pump may be driven by an electric drive system, and the boost pump may circulate hydraulic fluid through at least a part of the electric drive system for cooling purposes.

Optionally or additionally, the hydraulic fluid may be circulated by the boost pump through a heat exchange path in the electric drive system, and/or a pressure relief valve may connected across the heat exchange path to prevent excessive pressure from building up in the heat exchange path.

Optionally or additionally, the electric drive system may include a liquid cooled motor through which the hydraulic fluid is circulated.

Optionally or additionally, the electric drive system may include a liquid cooled electronic module through which the hydraulic fluid is circulated.

Optionally or additionally, the boost pump may circulate hydraulic fluid through a heat exchanger to remove heat from the hydraulic fluid.

Optionally or additionally, the boost pump may be driven by an electric boost pump motor.

Optionally or additionally, the bidirectional pump may be driven by an electric bidirectional pump motor, and a system controller may be provided to control the boost pump and bidirectional pump motors.

Optionally or additionally, current to the boost pump motor may be controlled as a function of the commanded speed of the bidirectional pump motor, thereby to increase boost system pressure for higher operating speeds of the bidirectional pump motor.

Optionally or additionally, when a load acting on the hydraulic cylinder will reverse drive the hydraulic cylinder to cause fluid to flow from the hydraulic cylinder independently of the bidirectional pump, such flow may be directed through at least one of the bidirectional and boost pumps to drive the respective electric motor for regeneration of electricity for energy recovery purposes.

Optionally or additionally, when a load acting on the hydraulic cylinder will reverse drive the hydraulic cylinder to cause fluid to flow from the hydraulic cylinder independently of the bidirectional pump, such flow may be directed via the third fluid flow line to the reservoir via a heat exchanger and filter.

The hydraulic system may comprise a plurality of the actuator systems, with the third fluid flow lines of the plurality of actuator systems being connected together and to the boost system that is shared by the plurality of actuator systems, whereby excess fluid from one actuator system can be used to supply make-up fluid to another actuator system while the boost pump maintains boost pressure at a prescribed level.

According to a further aspect of the invention, an electro-hydraulic system is provided with improved performance, fluid conditioning and electronics cooling. To this end, a bi-directional pump is driven by an electric drive system through which system fluid is circulated by a boost pump system, in particular the boost system used to provide make-up fluid or accept excess fluid.

Thus, a hydraulic system according to this aspect of the invention comprises at least one actuator system for extending and retracting a respective unbalanced hydraulic cylinder having a head-end chamber and a rod-end chamber. The actuator system comprises first and second fluid flow lines respectively connectable to the head-end and rod-end chambers of the hydraulic cylinder; a bi-directional pump operable in one direction for supplying pressurized fluid to the first fluid flow line for delivery to the head-end chamber of the hydraulic cylinder, and operable in a second direction opposite the first direction for supplying pressurized fluid to the second fluid flow line for delivery to the rod-end chamber of the hydraulic cylinder; and an electric drive system for driving the bi-directional pump. The hydraulic system further comprises a boost system for accepting or supplying fluid from or to the first and second fluid flow lines. The boost system includes a boost pump for supplying pressurized fluid to the third fluid flow line at a pressure normally less than the pressure at which fluid is supplied to the first and second fluid flow lines by the bi-directional pump, and for circulating hydraulic fluid through at least a part of the electric drive system for cooling purposes.

Optionally or additionally, the hydraulic fluid may be circulated by the boost pump through a heat exchange path in the electric drive system, and a pressure relief valve may be connected across the heat exchange path to prevent excessive pressure from building up in the heat exchange path.

Optionally or additionally, the electric drive system may include a liquid cooled motor through which the hydraulic fluid is circulated.

Optionally or additionally, the electric drive system may include a liquid cooled electronic module through which the hydraulic fluid is circulated.

Optionally or additionally, the boost pump may circulate hydraulic fluid through a heat exchanger to remove heat from the hydraulic fluid.

Optionally or additionally, the boost pump may be driven by an electric boost pump motor.

Optionally or additionally, a system controller may be provided to control the boost pump and bidirectional pump motors.

Optionally or additionally, current to the boost pump motor may be controlled as a function of the commanded speed of the bidirectional pump motor, thereby to increase boost system pressure for higher operating speeds of the bidirectional pump motor.

Further features of the invention will become apparent from the following detailed description when considered in conjunction with the drawings.

DETAILED DESCRIPTION

Figure 1:
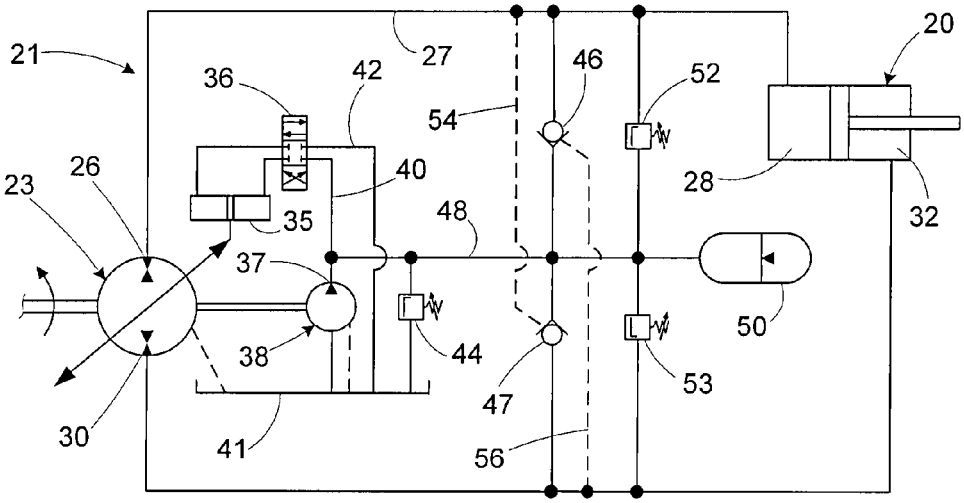
FIG. 1 ( Prior Art )
FIG. 1 is a schematic illustration of an exemplary prior art open circuit hydraulic flow management system for an unbalanced hydraulic cylinder, employing continuously rotating pumps and an inlet accumulator.
Figure 3:
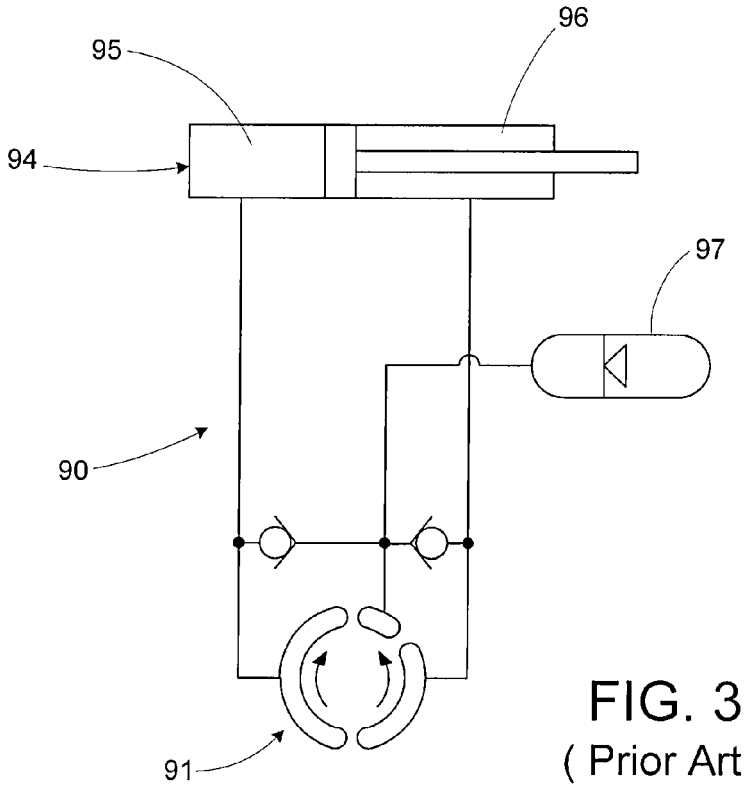
FIG. 3 ( Prior Art )
FIG. 3 is a schematic illustration of an exemplary prior art hydraulic flow management system including a three-port pump and an accumulator.
Figure 2:
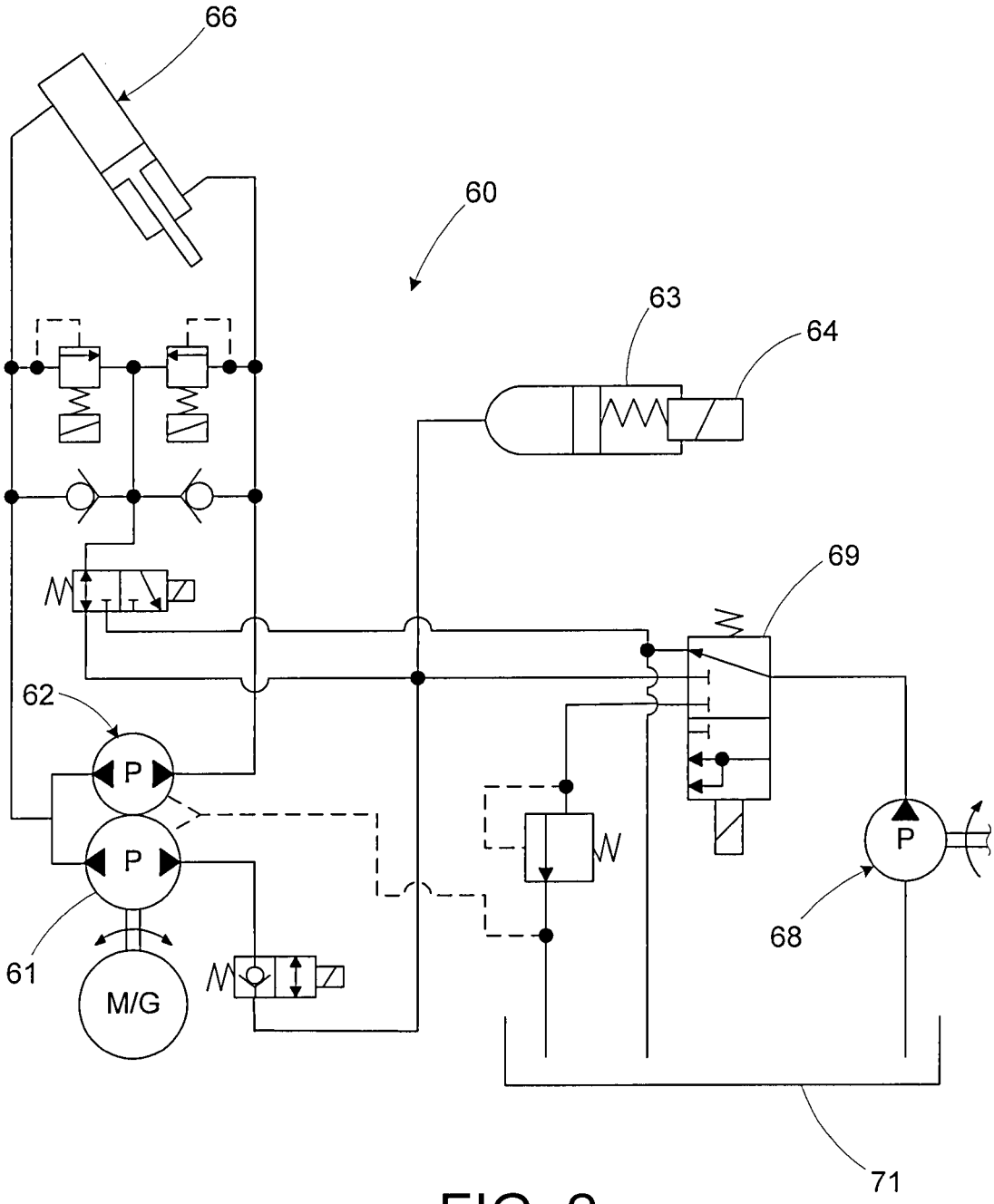
FIG. 2 ( Prior Art )
FIG. 2 is a schematic illustration of an exemplary prior art closed circuit electro-hydrostatic actuation system including bi-directional rotating pumps and an inlet accumulator.
Figure 4:
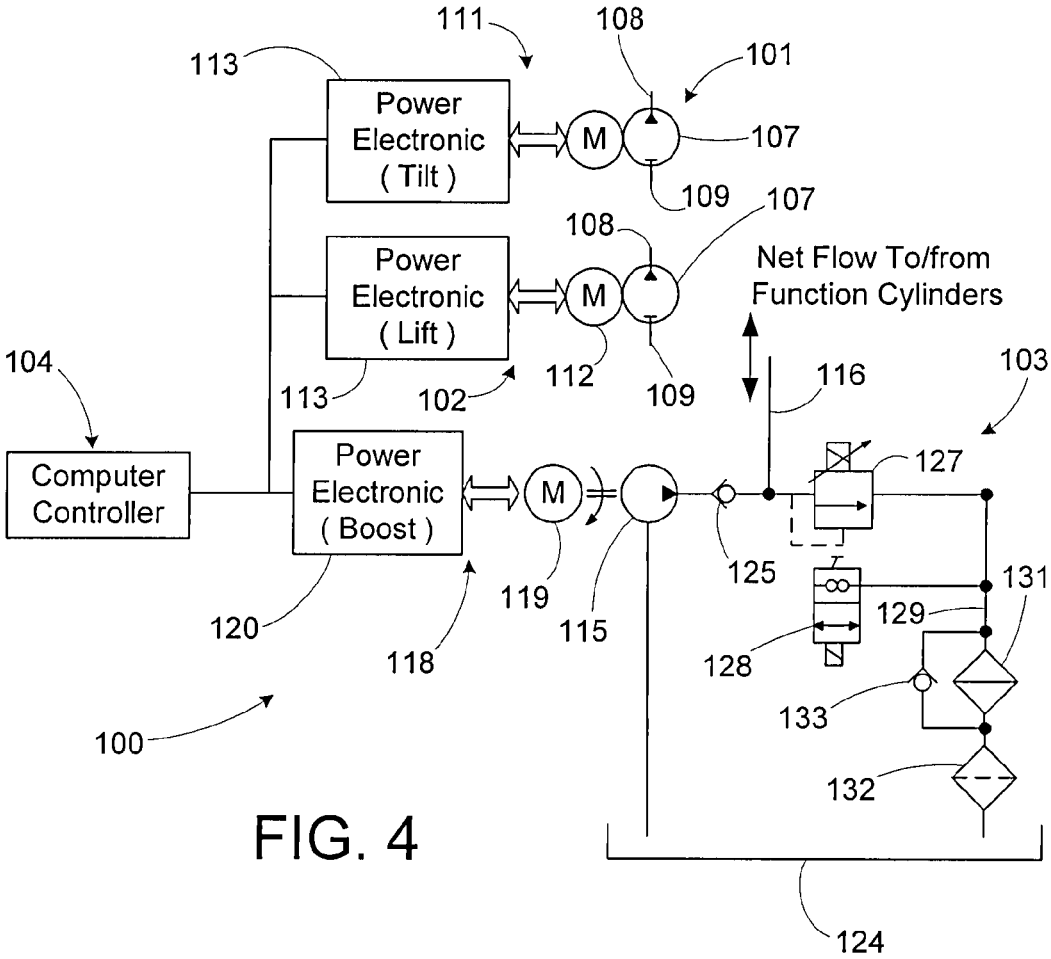
FIG. 4 is a schematic illustration of an exemplary flow management system according to the invention.

Referring now in detail to the drawings and initially to FIG. 4, an exemplary flow management system according to the invention is depicted at 100. The system 100 comprises at least one actuator system (two actuator systems 101 and 102 are shown by way of example, but the number may be varied for any given application), a boost system 103 for accepting or supplying fluid from or to the one or more actuator systems, and a controller 104.

Each actuator system 101, 102 includes a bi-directional pump 107 operable in one direction for supplying pressurized fluid from one inlet/outlet port 108 to a hydraulic actuator (not shown) for operating the actuator in one direction, and operable in a second direction opposite the first direction for supplying pressurized fluid from another inlet/outlet port 109 to the hydraulic actuator for operating the actuator in a direction opposite the first direction. Each actuator system also includes an electric bi-directional pump drive 111 for driving the bi-directional pump in either direction. The pump drive 111, as shown, may include an electric motor 112 and an electronic motor power controller 113 that controls the power supplied to the motor in accordance with command signals received from the controller 104. The fluid circuit (not shown) of each actuator system may be suitably configured as desired, with an exemplary circuit hereinafter being described in detail in connection with FIG. 8.

The boost system 103 includes a boost pump 115 (also herein referred to as a charge pump) for supplying fluid to a fluid make-up/return line 116. The make-up/return line 116 selectively is in fluid communication with one of the inlet/outlet ports of the bi-directional pump 107 when the other of the inlet/output ports is supplying pressurized fluid to the hydraulic actuator, thereby to provide hydraulic fluid at a desired inlet pressure to prevent cavitation. The boost system also includes an electric boost pump drive 118 for driving the boost pump. The drive 118 may include a motor 119 and an electronic motor power controller 120.

The controller 104, which may be referred to as a hydro-electro-mechanical control unit, includes at least one logic device for controlling operation of the electric bi-directional pump drive 102 and the boost pump drive 118. The logic device or devices may be of any suitable type, such as a programmed processor, computer, programmed logic controller, and the like. The functions of the controller may be consolidated in a single logic device or distributed amongst two or more logic devices as desired. The controller 104 typically will receive inputs, e.g. commands, from an operator-controlled devices, such as control levers in the operator compartment of a wheel loader. The inputs are interpreted for controlling the direction and speed of the bi-directional pump motor 112 of a corresponding actuator system. In addition, the hydro-electro-mechanical control unit may control the current to the boost pump motor 119 as a function of the commanded speed of the bidirectional pump motor, so as to increase boost system pressure for higher operating speeds of the bidirectional pump motor, or as needed to satisfy increased cooling requirements when the boost system is used to provide for cooling of system components, such as in the manner described below with reference to FIG. 9.

The boost pump 115 has an inlet for drawing fluid from a reservoir 124 and an outlet connected to the make-up/return line 116 via a check valve 125. The make-up/return line 116 preferably services both actuator systems 101 and 102 whereby return (excess) fluid from one actuator system can be used to supply make-up fluid directly (without passage through the reservoir 124) to another actuator system while the boost pump 115 maintains boost pressure at a prescribed level. The reservoir preferably is not pressurized, i.e. the reservoir is maintained at atmospheric or nominal pressure.

In a particular embodiment, the boost system motor and pump assembly may be of a wet submersible type installed directly in the reservoir thereby eliminating the need for a dynamic seal between the motor and the pump, other possible leakage points. Alternatively, the pump 115 alone may be submersed. As a further alternative, the motor 119 and pump 115 may be installed beneath or next to the reservoir as opposed to above it so as to eliminate the possibility of cavitation between the reservoir and the boost pump inlet communicating with the reservoir.

As seen in FIG. 4, an adjustable pressure relief valve 127 and flow control valve 128 (herein also referred to as a dump valve) are connected in parallel between the make-up/return line 116 and a reservoir return line 129 leading to the reservoir 124. The reservoir return line 129 may be provided with a heat exchanger 131 and filter 132 respectively extracting heat from the hydraulic fluid and for filtering the hydraulic fluid before return to the reservoir. A pressure relief bypass check valve 133 is provided across the heat exchanger to prevent the pressure differential across the heat exchanger from exceeding a level that would damage the heat exchanger.

The adjustable pressure relief valve 127 is controlled by the controller 104 to direct the net flow from the boost pump 115 to the actuation systems 101 and 102 or from the actuation systems to the reservoir 124 by adjusting the pressure drop across the pump outlet port and reservoir. In general, the control objective for positive net flow (toward the actuation systems) as determined by the computer controller is to create a large pressure drop across that path in order to supply the actuation systems with required flow. Under negative flow (directed toward the reservoir) as determined by the computer controller, a low pressure drop is desired to allow excessive fluid to be directed to the reservoir with low flow losses. Thus the pressure in line 116 to the actuation systems can be set by the adjustable relief valve as commanded by the computer controller.

The dump valve 128, connected in parallel with the pressure relief valve, allows flow to be circulated through the heat exchanger for hydraulic fluid cooling without added throttling losses across the relief valve 127. When open, the dump valve also allows hydraulic fluid to flow freely with minimum resistance to the reservoir 124 when it is desirable under certain operating conditions (such as the rapid lowering of a boom or arm of an implement) to retract an actuator as quickly as possible. Additionally, the dump valve may be opened to drop the EHA system pressure as low as possible during storage thereby eliminating the threat of prolonged external leakage.

In a preferred system, the boost pump motor command precedes the actuation system motor command thereby ensuring that the pressure to the actuation system pump inlet is adequate as the actuation pump accelerates.

The boost system 103 preferably is operated to provide a constant pressure on the make-up/return line 116, while supplying or accepting fluid as needed to meet requirements regardless of the number of cylinders. That is, the boost system may deliver an adjustable flow, yet constant pressure source to the make-up/return line 116 common to one or more of the actuation systems 101 and 102, while also preferably minimizing power consumption and maximizing energy recovery which is further discussed below. The adjustable flow, constant pressure minimizes if not eliminates pump cavitation.

As discussed in greater detail below, the logic device 104 controlling the boost pump drive 118 may be configured to control operation of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

The logic device controlling the boost pump drive may be configured to control operation of the boost pump drive in anticipation of the pressure or flow demands arising from commands controlling operation of the bi-directional pump drive.

Figure 5:
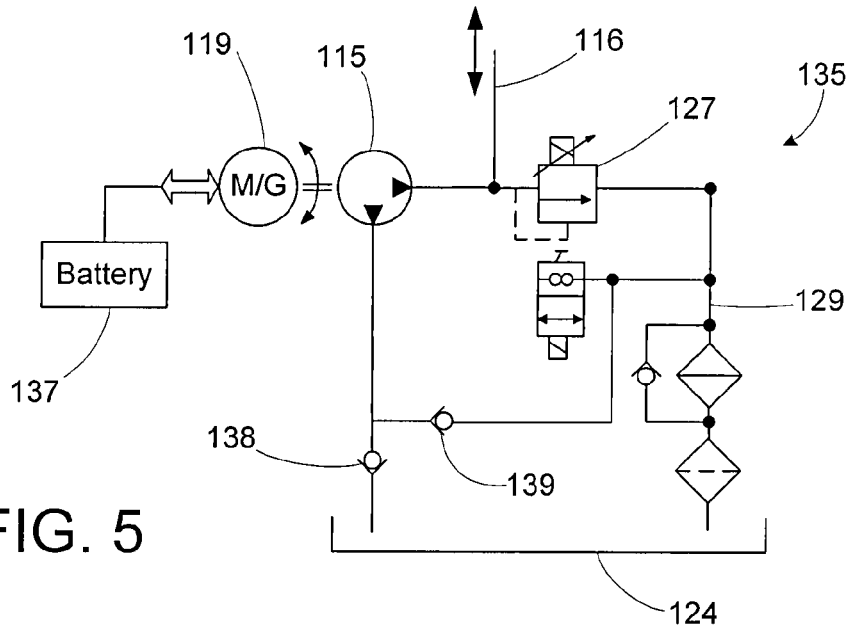
FIG. 5 is a schematic illustration of another exemplary flow management system according to the invention, with a boost pump being used to provide energy recovery.

Referring now to FIG. 5, a modified boost system is indicated generally at 135. The system 135 is substantially the same as the system 103, and like reference numerals are used to designate like components. The boost system 135, however, is modified for electrical energy recovery by reverse rotation of the motor/generator 119 and the return of electrical power to a storage device such as a battery 137. In this implementation, two check valves 138 and 139 are arranged as shown. The variable relief valve 127 typically would be set high so as to cause the pump 115 and motor/generator 119 to reverse drive and provide the return flow path to the reservoir 124.

Figure 6C:
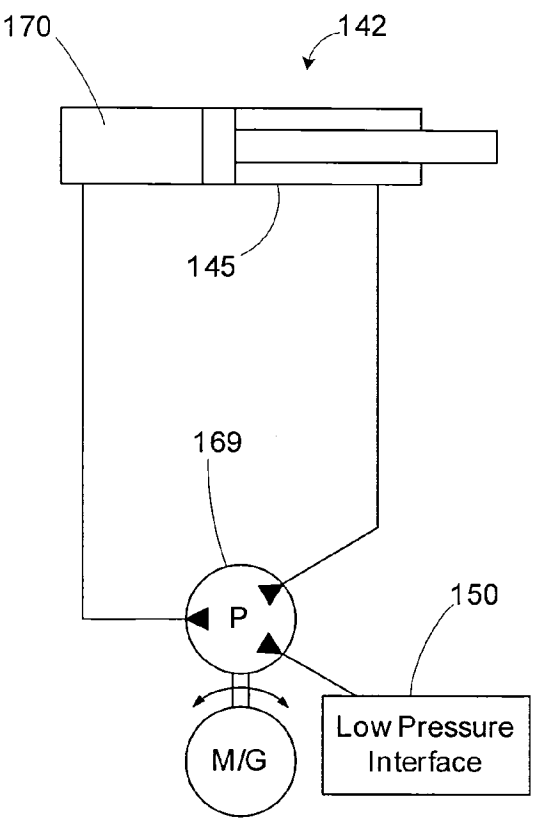
FIGS. 6A-6C are schematic illustrations of electro-hydrostatic actuation system circuits that can benefit a flow management system according to the invention.
Figure 6B:
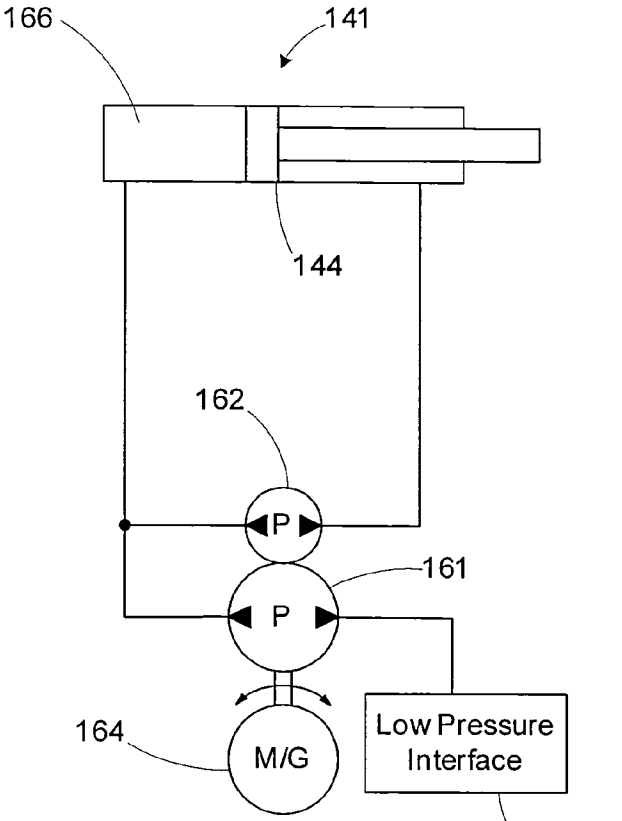
Figure 6A:
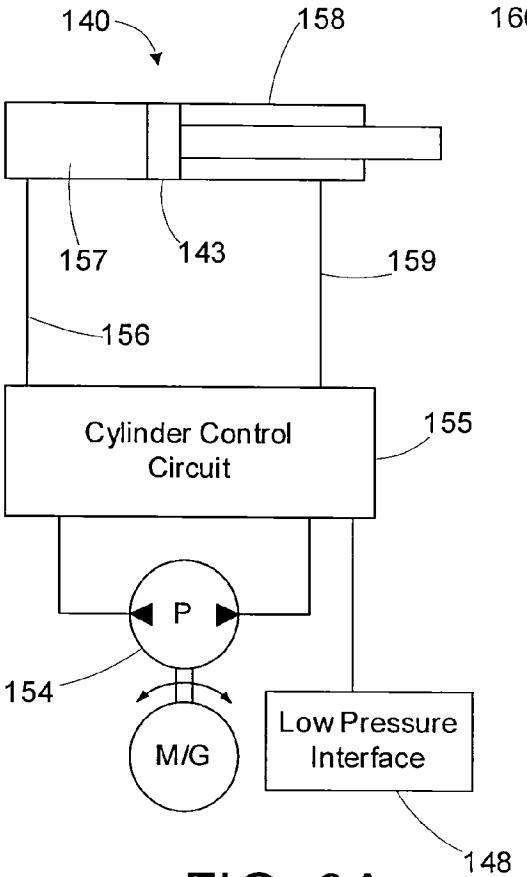

FIGS. 6A-6C show three simplified EHA hydraulic circuits 140, 141 and 142 that may benefit from the use of a flow management system in accordance with the invention. Each of these systems 140, 141, 142 have an unbalanced cylinder 143, 144, 145 that is provided with hydraulic fluid from one or two bi-directional electric motor driven pumps in a closed circuit. Each system has a low pressure hydraulic fluid interface 148, 149, 150 that could be an open tank or reservoir, an accumulator supplying an elevated inlet pressure or, as preferred, a pump supplied boosted inlet pressure, e.g. a boost system like that described above, that can eliminate the need for an accumulator.

An external load may be present due to work being carried out or due to the weight of the machine mechanisms being controlled, which load may be applied to the actuation cylinder in either the extend or retract direction. When the mechanism under external load is allowed to force a cylinder to retract or extend, the pump or pumps are reversely driven by hydraulic fluid from the cylinder and electrical energy is generated and sent back to the storage battery or engine driven generator. Thus considerable energy can be recovered saved and fuel costs and engine pollution can be substantially reduced.

FIG. 6A shows a bi-directional motor driven pump 154 in communication with the cylinder 143 by means of a cylinder control circuit 155. When the cylinder is commanded to extend, the pump supplies high pressure hydraulic fluid to line 156 which is in communication with the cylinder head end 157 while receiving low pressure hydraulic fluid from the rod end 158 of the cylinder through line 159. Since the volume of hydraulic fluid removed from the rod side of the cylinder is less than the hydraulic fluid required to fill the head side of the cylinder, the make-up hydraulic fluid is received from the low pressure interface 148. The cylinder control circuit 155 includes the necessary valves that are required to move the supply of hydraulic fluid to and from the low pressure interface.

In the circuit 141 shown in FIG. 6B, two bi-directional pumps 161 and 162 of different sizes are driven at the same speed by an electric motor 164 to supply and/or receive hydraulic fluid from the cylinder 144. This type of implementation is described in greater detail in U.S. Pat. No. 6,962,050 which is hereby incorporated herein by reference. In this implementation, the output flow rates of the two pumps usually must be matched to the cylinder areas under pressure.

When the cylinder 144 is extending, both pumps 161 and 162 supply hydraulic fluid volume at an elevated pressure to the cylinder head end 166. At the same time, the inlet or low pressure side of the upper pump 162 draws flow from the cylinder rod side while the lower pump 161 draws flow from the low pressure interface 149. The converse is true when the cylinder is retracting.

In this implementation the output flow rates of each of the two pumps usually must be uniquely matched to the size of the cylinder head area and the size of the cylinder piston rod annulus area since both are rotated by one motor at the same speed. As the result of this unique relationship, a significant manufacturing cost and inventory disadvantage is incurred in an industry that requires a number of different cylinder sizes.

The circuit shown in FIG. 6C uses a "three port" pump 169. Details of exemplary circuits of this type are described in U.S. Pat. Nos. 5,144,801 and 6,912,849, both of which are hereby incorporated by reference. The three port pump is designed such that its internal porting arrangement provides a division of flow in proportion to the cylinder head end and cylinder rod side areas. When the cylinder 145 is extending, the volumetric output of the pump 169 flowing into the cylinder head end 170 at an elevated pressure is equal to the sum of hydraulic fluid taken into the pump at a reduced pressure from the cylinder rod side 171 plus the necessary make up hydraulic fluid provided by the low pressure interface 150. The converse is true when the cylinder is retracting.

In this implementation, the design of the pump usually must be uniquely matched to the size of the cylinder head area and size of the cylinder piston rod annulus area. Again, as the result of this unique relationship, a significant manufacturing cost and inventory disadvantage is incurred in an industry that requires a number of different cylinder sizes.

Figure 7:
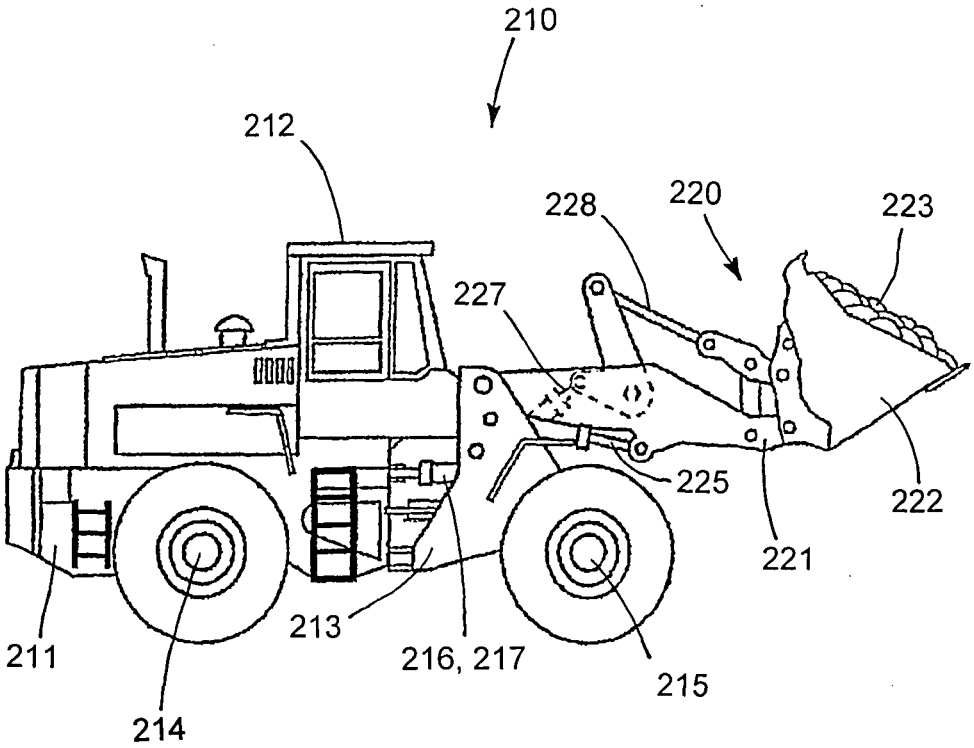
FIG. 7 is a side view of an exemplary work machine, specifically a wheel loader.

Referring now to FIG. 7, a exemplary application of principles of the invention is illustrated in the context of a wheel loader is indicated generally at 210. The wheel loader 210 comprises a rear vehicle part 211 including a cab/compartment 212 and a front vehicle part 213, which parts each comprise a frame and respective drive axles 214 and 215. The vehicle parts 211 and 213 are coupled together with one another in such a way that they can be pivoted relative to one another about a vertical axis by means of hydraulic cylinders 216, 217 which are connected to the two parts on opposite sides of the wheel loader. The hydraulic cylinders 216, 217 provide for steering, or turning, the wheel loader.

The wheel loader 210 further comprises an apparatus 220 for handling objects or material. The apparatus 220 comprises a lifting arm unit 221 and an implement 222 in the form of a bucket which is mounted on the lifting arm unit. The bucket 222 is shown filled with material 223. One end of the lifting arm unit 221 is coupled rotatably to the front vehicle part 213 for bringing about a lifting movement of the bucket. The bucket is coupled rotatably to an opposite end of the lifting arm unit for bringing about a tilting movement of the bucket.

The lifting arm unit 221 can be raised and lowered in relation to the front part 213 of the vehicle 210 by means of two hydraulic cylinders 225 on opposite sides of the lifting arm unit. The hydraulic cylinders are each coupled at one end to the front vehicle part 213 and at the other end to the lifting arm unit 221. The bucket 222 can be tilted in relation to the lifting arm unit 221 by means of a third hydraulic cylinder 227, which is coupled at one end to the front vehicle part and at the other end to the bucket via a link arm system 228.

The wheel loader 210 is shown and described to facilitate an understanding of the invention and not by way of limitation. As will be appreciated, the wheel loader is just one example of a work machine that may benefit from the present invention. Other types of work machines (including work vehicles) include, without limitation, excavator loaders (backhoes), excavating machines, mining equipment, and industrial applications and the like having multiple actuation functions include lifting arms, booms, buckets, steering and/or turning functions, and traveling means.

Figure 8:
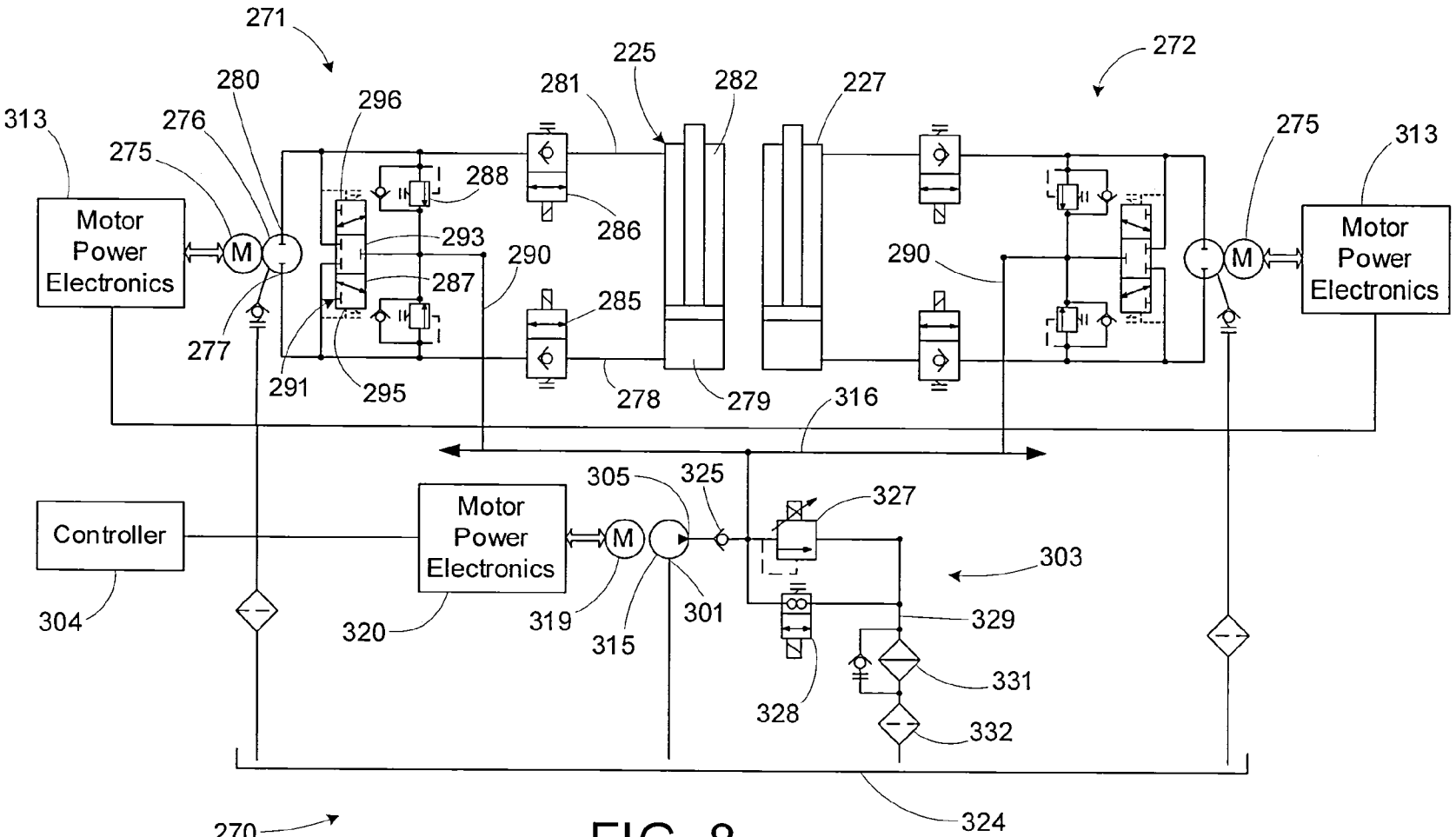
FIG. 8 is a schematic illustration of an exemplary hydraulic system according to the invention, having particular application for operating the tilt and lift cylinders of the wheel loader of FIG. 8.

Referring now to FIG. 8, an exemplary hydraulic system according to the invention is indicated generally at 270. In the system 270, flow management between a two port pump and an unbalanced cylinder is accomplished by a shuttle valve that is responsive to the pressure difference across the pump.

The illustrated exemplary system 270 is a hybrid electro-hydrostatic system that may comprise one or more actuator systems for extending and retracting a respective unbalanced hydraulic cylinder. By way of example, the system 270 has two such actuator systems 271 and 272 that may be used to control, for example, the lift and tilt cylinders 225 and 227 of the wheel loader 210. In the illustrated embodiment, the lift system includes two cylinders that share a pump and motor, although a separate pump and motor could be provided for each lift cylinder.

Although the systems 271 and 272 may be varied for a particular application, in the illustrated embodiment the two systems are functionally identical. Accordingly, only the system 271 will be described in greater detail, it being appreciated that such description is equally applicable to the other system 272.

The actuator system 271 controls the rate and direction of hydraulic fluid flow to the hydraulic cylinder 225. Such control is effected by controlling the speed and direction of an electric motor 275 used to drive a bidirectional pump 276. The pump 276 has one inlet/outlet port 277 connected by a line 278 to the head-end or extend chamber 279 of the hydraulic cylinder 225 and the other inlet/outlet port 280 connected by a line 281 to the rod-end or retract chamber 282 of the hydraulic cylinder. As illustrated, the pump case may have a drain leakage line connected to a reservoir 324. A hydraulic fluid filter may be included in the pump case path to the reservoir. The pump case may drain freely through the leakage line and the low internal pump pressure can ensure long life for the pump shaft seal.

The lines 278 and 281 may be provided with respective load holding valves 285 and 286 and pressure relief valves 287 and 288. The pressure relief valves are connected between the lines 278 and 281 and a common line 290. The pressure relief valves protect the pump and cylinder from the possibility of over pressurization in the event that an excessive external overload on the cylinder should be applied when the pump is in a neutral position providing relief of a high pressure in line 278 or 281. The load holding valves are used to do just that, to block flow from the cylinder to hold the position of the cylinder even when under load. Check valves may also be provided in parallel with the relief valves. The check valves prevent the possibility of cavitation from occurring in the circuit between the pump and respective load holding valves by ensuring connectivity with boost pressure preferably at all times.

Unless otherwise indicated, a fluid flow line may comprise one or more fluid passages, conduits or the like that provide the indicated connectivity.

A valve assembly 291 provides for connection of either side 279, 282 of the hydraulic cylinder 225 to the common line 290 that is connected to a make-up/return line 316 of a boost system 303. The valve assembly is operated by differential pressure between the lines 278 and 281 to connect the line 281 to the common line 290 when pressure in the line 278 exceeds the pressure in the line 281 by a prescribed amount whereby make-up fluid can be supplied through the common line to the line 281, and to connect the line 278 to the common line 290 when pressure in the line 281 exceeds the pressure in the line 278 by a prescribed amount whereby excess fluid from the head-end chamber 279 of the hydraulic cylinder 225 can be accepted by the common line 290.

The valve assembly 291 preferably includes a pilot-operated, three-position shuttle valve 293, the position of which is determined by differential pressure across the pump 276. The valve 293 has pilot ports 295 and 296 respectively connected to the lines 278 and 281. If the pump is driven by the motor 275 to supply fluid to the line 278 for extension of the hydraulic cylinder, the shuttle valve 293 will be shifted to connect line 281 to the common line 290 and block flow from line 278 to the common line. Conversely, when the pump is driven in the opposite direction to retract the hydraulic cylinder, the pressure differential across the pump will shift the shuttle valve so that it connects line 278 to the common line 290 and blocks flow from line 281 to the common line.

As will be appreciated, the shuttle valve 291 ensures that when one of the lines 278 and 281 are disconnected from the common line 290, the other line will be connected thereby to reduce if not eliminate the possibility of hydraulic lock up.

As above indicated, the common line 290 is connected to the make-up/return line 316 of the boost system 303 that can accept or supply fluid from or to the common line 290 of one or more of the actuator systems 271 and 272. The illustrated boost system includes a boost pump 315 for supplying pressurized fluid to the make-up/return line 316 at a pressure normally less than the pressure at which fluid is supplied to the lines 278 and 281 by the bi-directional pump 276. The boost pump may be of any suitable, preferably positive displacement, type including, for example, gear, vane or piston pumps.

The boost pump 300 has an inlet 301 for drawing fluid from a reservoir 324 and an outlet 305 connected to the make-up/return line 316 via a check valve 325. As seen in FIG. 8, the common lines 290 of plural actuator systems 271 and 272 are connected together and to the make-up/return line 316 of the boost system 303, whereby excess fluid from one actuator system can be used to supply make-up fluid to another actuator system while the boost pump maintains boost pressure at a prescribed level.

The boost pump 315 is driven by an electric boost pump motor 319. The boost pump and motor of the boost system may be of any suitable type. In a particular embodiment, the boost system motor and pump assembly may be of a wet submersible type installed directly in the reservoir thereby eliminating the need for a dynamic seal between the motor and the pump, and other possible leakage points. Alternatively, the pump alone may be submersed. As a further alternative, the motor and pump may be installed beneath or next to the reservoir as opposed to above it so as to eliminate the possibility of cavitation between the reservoir and the boost pump inlet communicating with the reservoir.

Power to the boost pump 315 is controlled by an electronic motor power controller 320 that in turn is controlled by a hydro-electro-mechanical control unit 304 that may also control a power control unit 313 for controlling power to the bi-directional pump motor 275 of one or more of the actuator systems 271 and 272. The hydro-electro-mechanical control unit 304 typically will receive inputs from operator controlled devices, such as levers in the compartment of the wheel loader 210 (FIG. 7), that are interpreted for controlling the direction and speed of the bi-directional pump motor 275. In addition, the hydro-electro-mechanical control unit 304 may control the current to the boost pump motor 319 as a function of the commanded speed of the bidirectional pump motor, so as to increase boost system pressure for higher operating speeds of the bidirectional pump motor, or as needed to satisfy increased cooling requirements.

In a preferred system, the boost pump motor command precedes the actuation system motor command thereby ensuring that the pressure to the actuation system pump inlet is adequate as the actuation pump accelerates.

The boost system 303 preferably is operated as above described in respect of the boost system shown in FIG. 4, i.e. to provide a constant pressure on the make-up/return line 316, while supplying or accepting fluid as needed to meet requirements regardless of the number of cylinders. That is, the boost system may deliver an adjustable flow, yet constant pressure source to the common line 290 of one or more of the cylinders, while also preferably minimizing power consumption and maximizing energy recovery which is further discussed below. The adjustable flow, constant pressure minimizes if not eliminates pump cavitation.

As will be appreciated, the motors and power control units collectively form an electric drive system. The boost pump 315 may also be operated to circulate hydraulic fluid through at least a part of the electric drive system for cooling purposes. As seen in FIG. 8, a pressure relief valve 327 and flow control valve 328 (herein also referred to as a dump valve) are connected in parallel between the make-up/return line 316 and a reservoir return line 329 leading to the reservoir 324. The reservoir return line 329 may be provided with a heat exchanger 331 and filter 332 respectively for extracting heat from the hydraulic fluid and filtering the fluid before return to the reservoir. The pressure relief valve 327 functions to maintain a constant pressure on common line 290. The flow control valve 328 can be opened to permit flow from the make-up/return line 316 to the heat exchanger and filter.

The adjustable pressure relief valve 327 in FIG. 8 is used to direct the net flow from the boost pump to the actuation systems or from the actuation systems to the reservoir by adjusting the pressure drop across the pump outlet port and reservoir. In general, the control objective for positive net flow (toward the actuation systems) as determined by the computer controller is to create a large pressure drop across that path in order to supply the actuation systems with required flow. Under negative flow (directed toward the reservoir) as determined by the computer controller, a low pressure drop is desired to allow excessive fluid to be directed to the reservoir with low flow losses. Thus the pressure in line 290 to the actuation systems is set by the adjustable relief valve as commanded by the computer controller. The dump valve allows flow to be circulated through the heat exchanger for hydraulic fluid cooling without added throttling losses across the relief valve. When open, the dump valve also allows hydraulic fluid to flow freely with minimum resistance to the reservoir when it is desirable under certain operating conditions (such as the rapid lowering of a boom or arm of an implement) to retract an actuator as quickly as possible. Additionally, the dump valve may be opened to drop the EHA system pressure as low as possible during storage thereby eliminating the threat of prolonged external leakage.

For energy recovery, a load acting to reverse drive the hydraulic cylinder 225 will cause fluid to flow from the hydraulic cylinder independently of the bidirectional pump 276. An external load may be present due to work being carried out or due to the weight of the machine mechanisms which will be applied to the actuation cylinders in either the extend or retract direction. When the mechanism under external load is allowed to force a cylinder to retract or extend, the pump 276 can be reversely driven by hydraulic fluid from the cylinder and electrical energy generated by the motor 275 acting now as a generator and sent back to the battery, engine driven generator or other energy storage or usage device. If an external load is applied in a direction to compress the cylinder 225, the hydraulic fluid pressure in line 278 will increase. The valve assembly 291 will be caused to move to block flow from line 278 to line 290 and allow excess flow from line 281 to pass into line 290. This flow can be used to reversely drive the boost pump 315 upon opening of the check valve 325, and this can reverse drive the boost pump motor/generator to generate electrical energy for storage or use elsewhere in the work machine. See FIG. 5 for an alternative check valve arrangement for energy recovery using the boost pump and boost pump motor. As will be appreciated, considerable energy can be saved and fuel costs and engine pollution can be substantially reduced.

Figure 9:
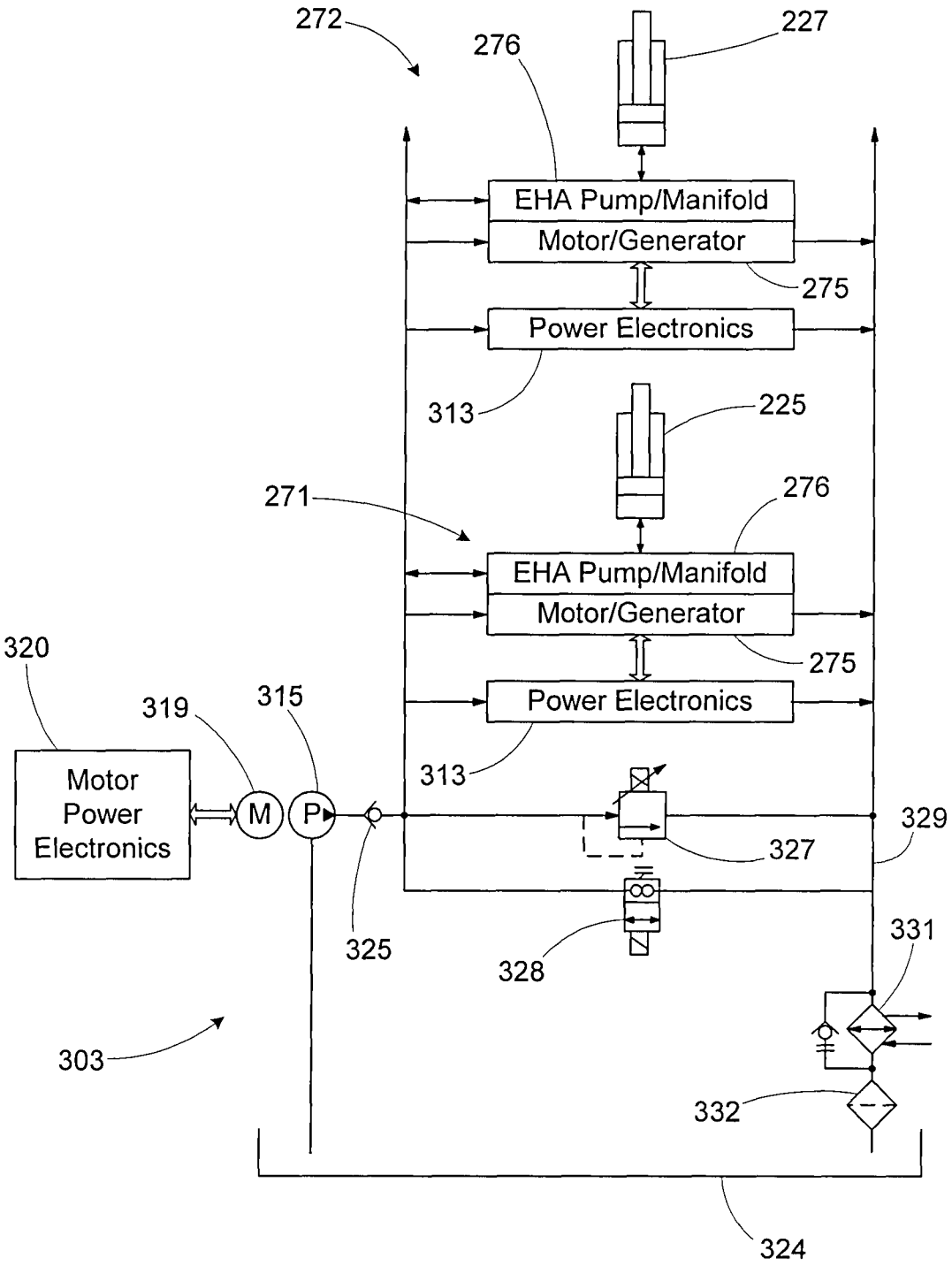
FIG. 9 is a schematic illustration showing use of the flow management system for cooling electrical components of an actuation system.

As seen FIG. 9, the boost pump 315, in addition to providing flow to and accepting flow from the make-up/return line 316, and/or providing energy recovery, may be used to provide flow of the hydraulic fluid through heat exchange paths in the bi-directional pump motors 275 and/or power control units 313, as well as through the manifolds in the pumps 276. To this end, the motors and/or electronic modules may be of a liquid-cooled type. Flow from the motors and electronic modules is returned to the reservoir return line 329 for flow through the heat exchanger 331 and filter 332 for conditioning of the fluid.

During operation, a small amount of hydraulic fluid, as may be limited by an orifice restriction or other suitable means, can be allowed to circulate through the electronics and motor/generators as supplied by boost pump 315 and returned to the heat exchanger 331.

For fluid warm-up during start-up from a cold environment, the boost pump 315 can be operated to circulate hydraulic fluid across the variable pressure relief valve 327. The throttling pressure drop across the valve warms up the fluid in the reservoir. Additional valves could be used for warm-up of fluid within the actuation system circuit. Another option is to exercise the cylinders, whereby hydraulic fluid may be circulated through the actuation system to speed the warm-up process.

Figure 10:
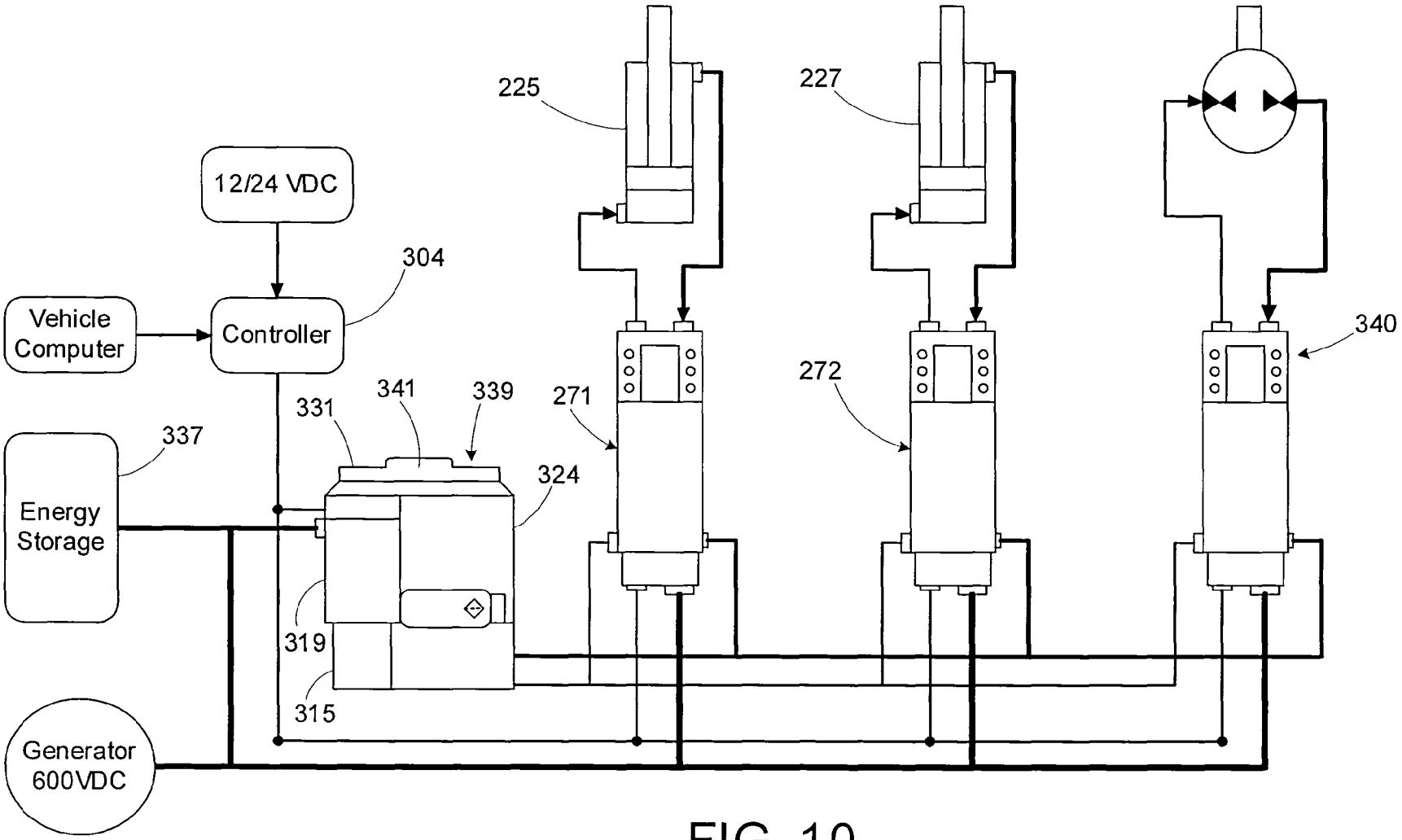
FIG. 10 is a schematic illustration of a physical implementation of the hydraulic system of FIGS. 9 and 10.

Turning now to FIG. 10, an exemplary physical implementation of the hydraulic system is illustrated. The boost pump 315 and boost pump motor 319 are shown packaged at 339 with the reservoir 324. Coolant supply and return lines run between the boost pump/reservoir and the actuator systems 271 and 272, as well as a further rotary actuator system 340. Power and control lines are also illustrated, as well as an energy storage 337 which may be, for example, a battery. The compact integrated package 339 may contain the heat exchanger 331 with cooling fan 341 for hydraulic fluid cooling a well as hydraulic fluid warm up. The integrated package may also include the filter 332 for hydraulic fluid filtration. In this embodiment, the boost pump 315 is shown submersed in reservoir hydraulic fluid 324.

Figure 11:
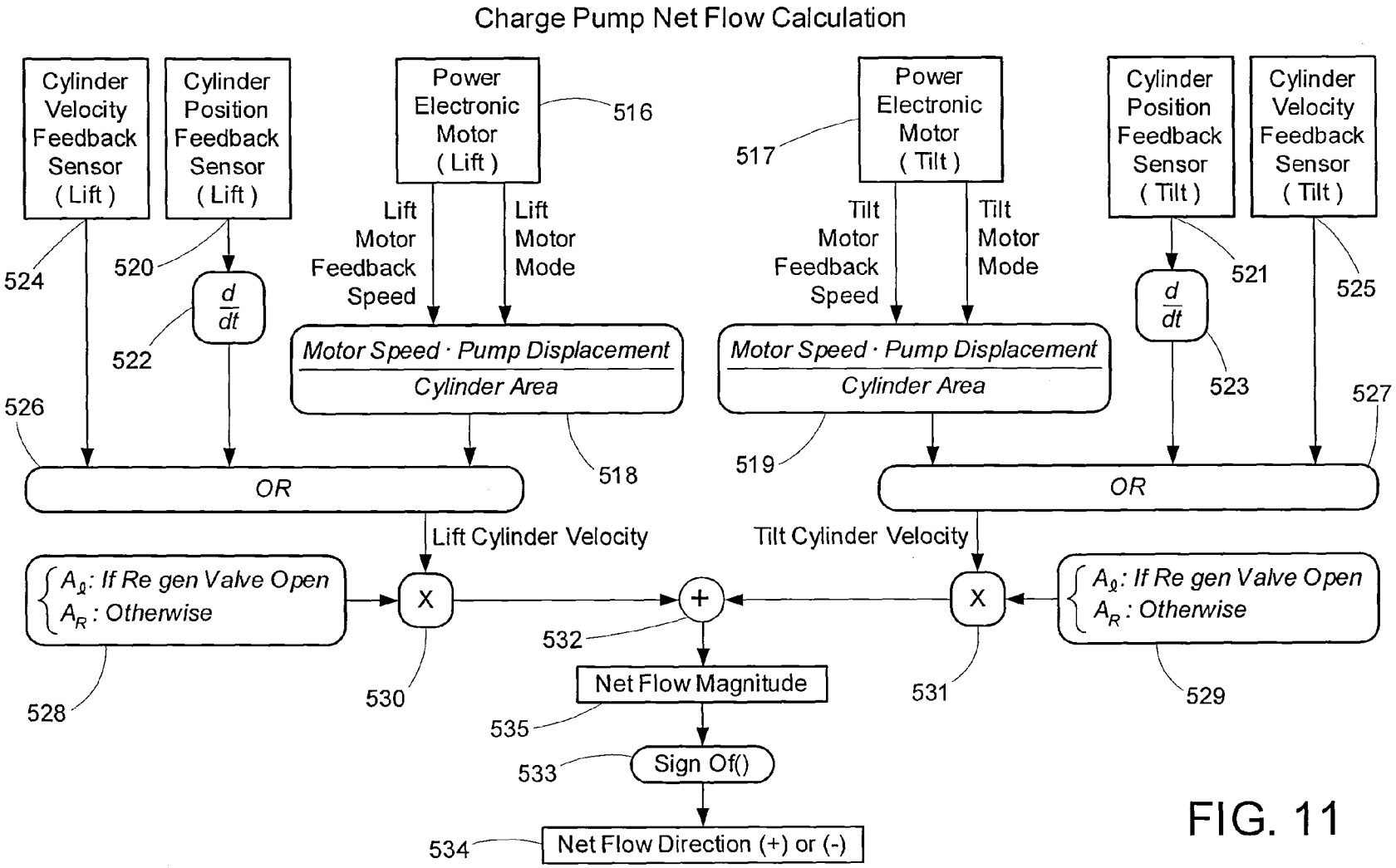
FIG. 11 shows an information flow diagram explaining how the magnitude and direction of net differential flow may be calculated.
Figure 12:
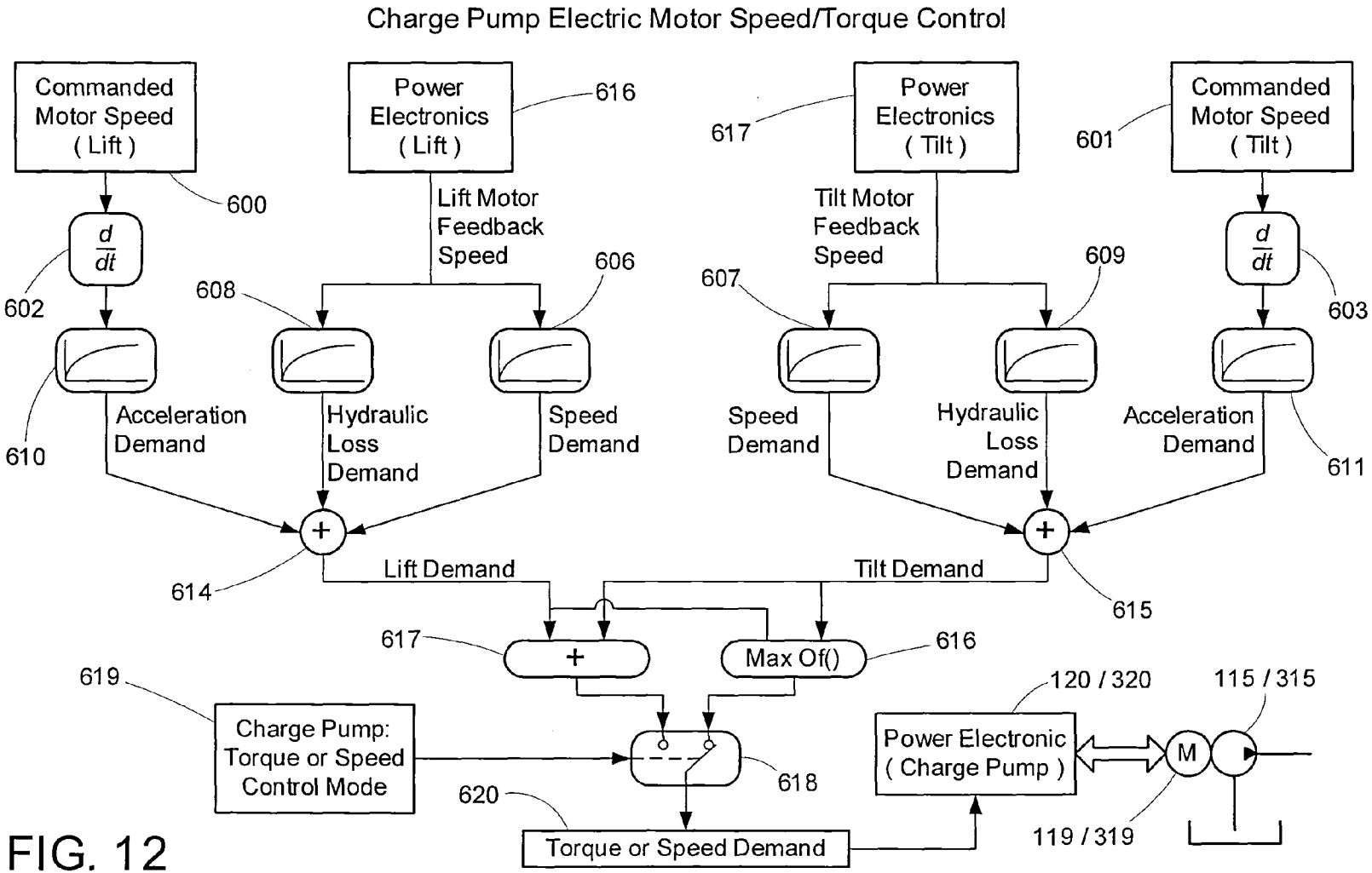
FIG. 12 shows an information flow diagram illustrating an exemplary control of the boost motor/pump speed or torque.
Figure 13:
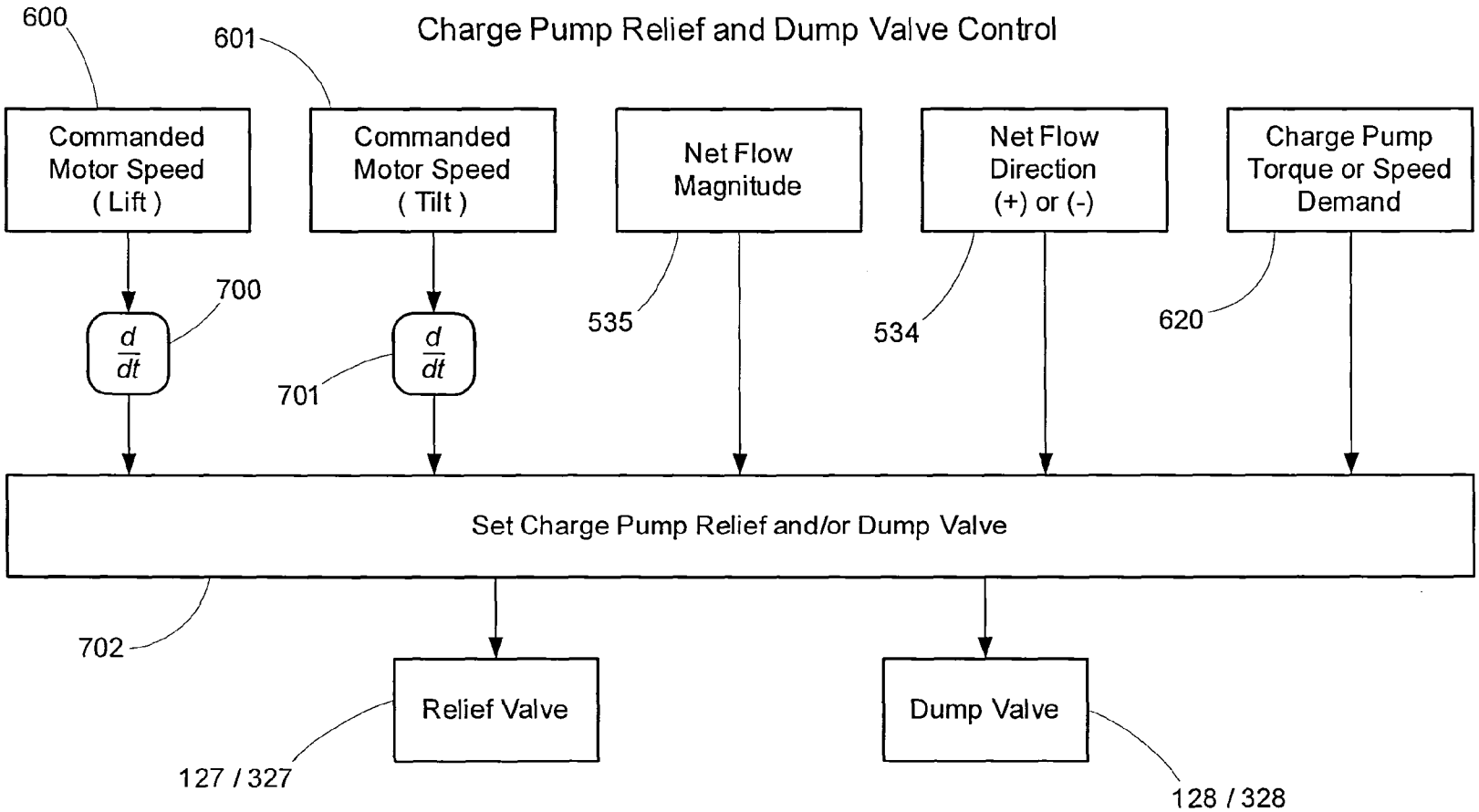
FIG. 13 shows an information flow diagram illustrating an exemplary control of hydraulic valves associated with the boost system.

Referring now to FIGS. 11-13, further details of exemplary system control will now be described. In order to achieve a desired functionality of a charge pump system, such as the charge pump system 103 (FIG. 4) or 303 (FIG. 8), the computer controller unit, such as the computer control unit 104/304, which can receive feedback signals such as electric motor speeds, cylinder and valve states, can compute required charge pump electric motor speed or torque that are sent to the motor power electronic controller, such as the controller 120/320, which amplifies low power control signals into high power electric motor commands. FIGS. 11-13 illustrate in detail a control algorithm implementation for the computer controller.

As illustrated in FIG. 11, the magnitude and direction of charge pump net flow is calculated based on one or several feedback signals. In a preferred embodiment of the invention particularly applicable to a system for controlling lift and tilt implement functions of a work machine such as a wheel loader, the power electronic controllers (denoted by reference numerals 516 and 517) of the lift and tilt implement functions provide electric motor speed and mode of operation (powering or braking) feedback signals. Based on feedback information and system parameters such as displacement constants of the function pumps 107/307 as well as hydraulic cylinder dimensions, cylinder rod velocities are calculated in 518 and 519 as:

$$\text{Cylinder Velocity} = \frac{\text{Motor Speed} \cdot \text{Pump Displacement}}{\text{Cylinder Area} = f(\text{Motor Mode})}$$

These calculations may furthermore include a term to account for fluid leakage losses in pumps, hydraulic lines and valves. Depending on the system architecture and availability of feedback devices, cylinder velocities may also be obtained from feedback position sensors 520 and 521 due to differentiation 522 and 523. If cylinders are directly equipped with velocity sensors, no additional calculation needs to be performed at this point. Cylinder net hydraulic flow is then obtained by multiplication 530 and 531 of cylinder velocity with cylinder area 528 and 529 (cylinder annulus area used if regen valve is opened, rod area used otherwise):

$$\text{Net Flow} = \text{Cylinder Velocity} \cdot \text{Area}$$

$$\text{with: Area} = \begin{cases} \text{Annulus Area: if Re } gen \text{ valve open} \\ \text{Rod Area: otherwise} \end{cases}$$

All individual function net flows are summed in 532 to obtain the magnitude of total system hydraulic net flow 535. By evaluating the sign of the net flow in 533, the flow direction can be obtained 534 for use in further computations. In the preferred embodiment, net flow is defined as positive (+) net flow if the charge pump supplies flow to 116/316, and as negative (−) net flow if the charge pump receives excessive function flow from 116/316.

FIG. 12 illustrates a control scheme algorithm used to generate a torque and speed output of the charge pump electric motor (such as the boost pump motor 119/319) in accordance with a control objective of the invention, that is, to provide charge pump output pressure and flow to satisfy the function pump (107/307) needs. Generally, if a pump is supplying flow to move a cylinder supporting a load at a commanded speed, there is a desired pressure the pump needs to supply for this motion to be achieved. This pressure will depend on the commanded speed, the load, hydraulic line losses, and/or the acceleration of the load. Therefore, the charge pump desirably supplies a pressure that is a function of one or more of the following four factors:

$$P_{Change} = f(V_{com}) + f(f_L) + f(H_{LL}) + f(\alpha)$$

Where $v_{com}$ is the commanded speed, $f_L$ is the load, $H_{LL}$ is the hydraulic line losses, and $\alpha$ is acceleration. A charge pump system may be operated in pressure control or flow control mode in order to achieve a desired output flow and pressure. In order to operate the charge pump in pressure control mode, the electric motor should be controlled in torque control mode, while it would be controlled in speed control mode to operate the charge pump in flow control mode.

With reference to FIG. 12, the charge pump electric motor (119/319) may be controlled by several factors as stated in the preceding equation. First, function electric motor feedback speeds 616 and 617 can be mapped to a speed torque demand using a linear or non-linear function or a lookup table 606 and 607. Also based on function electric motor feedback speed is a mapping to estimate hydraulic losses that are to be compensated by another speed torque demand based on these hydraulic losses 608 and 609. Third, the rate of change of commanded motor speeds is evaluated. Thereto, commanded electric motor speeds 600 and 601 can be obtained though operator input such as a joystick or other input devices. These commands are differentiated with respect to time 602 and 603 to obtain the rate of change of commanded speed. The command rate of change can then be mapped to an acceleration torque demand using a linear or non-linear function or a lookup table 610 and 611. It is noted, that in a preferred embodiment of the invention, the load at the cylinder $f_L$ does not have to be taken into consideration because the charge pump system only provides input to the function pumps but does not directly contribute to manipulate the load. If one were to operate the main pumps in pressure control mode (e.g. for another application) one might have to add pressure feedback to the main pump controller.

Total charge pump speed or torque demand can be summed for each function in 614 and 615. If it is desired to operate the charge pump electric motor in torque control mode, it is sufficient to satisfy the larger of the two independent function torque demands 616 to generate required charge pump output pressure. A mode selector 619 in conjunction with a switch 618 can feed torque demand 620 to the motor power electronic controller (120/320). If it is desired to operate the charge pump electric motor in speed control mode, the individual function demands 614 and 615 can be summed in 617 to obtain the total charge pump system flow demand. In this case, the mode selector 619 and switch 618 feed speed demand 620 to the motor power electronic controller (120/320).

Referring now to FIG. 13, a charge pump relief and dump valve control scheme is described that can be used to direct the net flow from charge pump to functions or from functions to reservoir by adjusting the pressure drop across the pump outlet port and reservoir. In general, the control objective for positive (+) net flow is to create a large pressure drop across that path in order to supply the functions with required flow. Under negative (−) net flow, a low pressure drop is desired to allow excessive fluid to be directed to the reservoir at low flow losses. Depending on the hydraulic system and its application, the charge pump relief valve (127/327) and dump valve (128/328) may be controlled proportionally or in discrete states.

The valve states may be controlled by several factors. First, the rate of change of commanded motor speeds can be evaluated in 700 and 701, used to anticipate a large change of net flow demand. Second, the magnitude of the net flow 535 can be observed in order to decide when to minimize and maximize the pressure drop across the charge pump valves. In a preferred embodiment of the invention, for example, under a very large negative (−) net flow, it might be desirable at 702 to not just open the relief valve (127/327) but also the dump valve (112/312) in an effort to minimize pressure drop losses. In a similar manner, the direction of net flow 534 may be used to control the valve states. Additionally, the previously computed charge pump torque or speed demand 620 may be used to control the sates of charge pump valves. For example, if the charge pump electric motor is being commanded to a high speed or torque, it is implied that the system implement functions need to be supplied with flow in order to achieve the desired motion. In such a case, a high pressure drop across the charge pump relief and dump valve would be desired to direct the charge pump positive (+) flow from charge pump to function pumps. If desired, only a dump valve or relief valve could be used. In addition, the charge pump as above discussed could be bidirectional and could be used for energy recovery. In order to do so, the pump would be back-driven by negative (−) net flow when closing the dump and relief valves. By adjusting the braking torque at the electric motor, it would be possible to vary the pressure drop for the return flow from the functions to reservoir.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic system with hydraulic fluid flow management, comprising at least one actuator system, a boost system for accepting or supplying fluid from or to the at least one actuator system, and a controller;

the actuator system including a hydraulic actuator to and from which hydraulic fluid is supplied and returned in opposite directions to operate the actuator in opposite directions, a bi-directional pump operable in one direction for supplying pressurized fluid from a first inlet/outlet port to the hydraulic actuator for operating the actuator in one direction, and operable in a second direction opposite the first direction for supplying pressurized fluid from a second inlet/outlet port to the hydraulic actuator for operating the actuator in a direction opposite the first direction, and an electric bi-directional pump drive for driving the bi-directional pump in either direction;

the boost system including a boost pump for supplying fluid to a fluid make-up/return line that selectively is in fluid communication with one of the inlet/outlet ports of the bi-directional pump when the other of the inlet/output ports is supplying pressurized fluid to the hydraulic actuator, and an electric boost pump drive for driving the boost pump; and the controller including at least one logic device for controlling operation of the electric bi-directional pump drive and the boost pump drive, the logic device controlling the boost pump drive being configured to control operation of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

2. A hydraulic system as set forth in claim 1, wherein the logic device controlling the boost pump drive is configured to control operation of the boost pump drive in anticipation of the pressure or flow demands arising from commands controlling operation of the bi-directional pump drive.

3. A hydraulic system as set forth in claim 1, wherein the boost system includes a pressure relief valve for limiting the pressure in the make-up/return line to less than the pressure of the pressurized fluid being supplied to the actuator.

4. A hydraulic system as set forth in claim 3, wherein the pressure relief valve or a dump valve is selectively operable by the controller to connect the make-up/return line to a hydraulic fluid reservoir such that the pressure at the make-up/return line will be rapidly reduced to facilitate acceptance of fluid from the actuator system.

5. A hydraulic system as set forth in claim 4, including the dump valve connected in parallel with the pressure relief valve between the make-up/return line and the reservoir.

6. A hydraulic system as set forth in claim 4, wherein the reservoir is not pressurized.

7. A hydraulic system as set forth in claim 1, wherein the at least one actuator system includes a plurality of actuator systems each including a respective a hydraulic actuator to and from which hydraulic fluid is supplied and returned in opposite directions to operate the actuator in opposite directions, a bi-directional pump operable in one direction for supplying pressurized fluid to the hydraulic actuator for operating the actuator in one direction, and operable in a second direction opposite the first direction for supplying pressurized fluid to the hydraulic actuator for operating the actuator in a direction opposite the first direction, and an electric bi-directional pump drive for driving the bi-directional pump; and wherein the make-up/return line is common to the plurality of actuator systems, and the boost pump drive is controlled on the basis of the net hydraulic fluid make-up flow or pressure demand of the plurality of actuator systems.

8. A hydraulic system as set forth in claim 7, wherein the boost system is controlled to dump to reservoir net excess return fluid received from the plurality of actuators.

9. A hydraulic system as set forth in claim 1, further comprising an electrical energy storage device, and wherein the boost pump drive can be reversely driven by flow through the pump from the make-up/return line to the reservoir to generate electrical energy for storage in the electrical energy storage device.

10. A hydraulic system as set forth in claim 1, wherein hydraulic fluid from the make-up return line is circulated through at least a part of one of the pump drives.

11. A hydraulic system as set forth in claim 10, wherein each pump drive includes an electric motor and power circuitry for supplying power to the pump motor when commanded by the controller, and hydraulic fluid from the make-up return line is circulated in heat exchange relationship with the power circuitry.

12. A hydraulic system as set forth in claim 1, wherein the controller controls the speed of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

13. A hydraulic system as set forth in claim 1, wherein the controller controls the output torque of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

14. A hydraulic system as set forth in claim 1, wherein the hydraulic actuator is an unbalanced hydraulic cylinder having a head-end chamber and a rod-end chamber, the actuator system includes first and second fluid flow lines respectively connected between the head-end and rod-end chambers of the hydraulic cylinder and respective inlet/outlet ports of the bi-directional pump, whereby operation of the pump in a first direction will supply pressurized fluid to the first fluid flow line for delivery to the head-end chamber of the hydraulic cylinder while drawing fluid through the second fluid flow line from the rod-end of the cylinder, and operation of the pump in a second direction opposite the first direction will supply pressurized fluid to the second fluid flow line for delivery to the rod-end chamber of the hydraulic cylinder while drawing fluid through the first fluid flow line from the head-end of the cylinder;

a valve assembly connected between the first and second fluid flow lines and a third fluid flow line, the valve assembly being operated by differential pressure between the first and second fluid flow lines to connect the second fluid flow line to the third fluid flow line when pressure in the first fluid flow line exceeds the pressure in the second fluid flow line by a prescribed amount whereby make-up fluid can be supplied through the third fluid flow line to the second fluid flow line, and to connect the first fluid flow line to the third fluid flow line when pressure in the second fluid flow line exceeds the pressure in the first fluid flow line by a prescribed amount whereby excess fluid from the head-end chamber of the hydraulic cylinder can be accepted by the third fluid flow line; and the make-up/return line of the boost system is connected to the third fluid flow line.

15. A system as set forth in claim 1, wherein the boost pump circulates hydraulic fluid through at least one of a heat exchanger to remove heat from the hydraulic fluid and a filter to remove contaminants.

16. A system as set forth in claim 15, wherein the heat exchanger discharges hydraulic fluid to a reservoir.

17. A system as set forth in claim 1, wherein current to the boost pump motor is controlled as a function of the commanded speed of the bidirectional pump motor, thereby to increase boost system pressure for higher operating speeds of the bidirectional pump motor.

18. A system as set forth in claim 1, wherein when a load acting on the hydraulic actuator will reverse drive the hydraulic actuator to cause fluid to flow from the hydraulic actuator independently of the bidirectional pump, such flow is directed through at least one of the bidirectional and boost pumps to drive the respective electric motor for regeneration of electricity for energy recovery purposes.

19. A system as set forth in claim 1, wherein the at least one actuator system includes a plurality of the actuator systems that share the boost system, whereby excess fluid from one actuator system can be used to supply make-up fluid to another actuator system while the boost pump maintains boost pressure at a prescribed level.

20. A hydraulic system as set forth in claim 1, wherein the logic device controlling the boost pump drive being configured to control operation of the boost pump drive based on at least one of (a) a speed at which the bi-directional drive is commanded to operate, (b) a load acting on the electric bi-directional pump drive, (c) hydraulic line losses in the actuator system, (d) a commanded acceleration of the bi-directional drive, and (e) combinations of two or more thereof.

21. A hydraulic system as set forth in claim 1, wherein the logic device controlling the boost pump drive being configured to control operation of the boost pump drive based on at least a speed at which the bi-directional drive is commanded to operate.

22. A hydraulic system as set forth in claim 1, wherein the logic device controlling the boost pump drive being configured to control operation of the boost pump drive based on at least a load acting on the electric bi-directional pump drive.

23. A hydraulic system as set forth in claim 1, wherein the logic device controlling the boost pump drive being configured to control operation of the boost pump drive based on at least a commanded acceleration of the bi-directional drive.

24. A hydraulic system comprising at least one actuator system for extending and retracting a respective unbalanced hydraulic cylinder having a head-end chamber and a rod-end chamber, the actuator system comprising:

first and second fluid flow lines respectively connectable to the head-end and rod-end chambers of the hydraulic cylinder; and a bi-directional pump operable in one direction for supplying pressurized fluid to the first fluid flow line for delivery to the head-end chamber of the hydraulic cylinder, and operable in a second direction opposite the first direction for supplying pressurized fluid to the second fluid flow line for delivery to the rod-end chamber of the hydraulic cylinder; and an electric drive system for driving the bi-directional pump; and the hydraulic system further comprising a boost system for accepting or supplying fluid from or to the first and second fluid flow lines, the boost system including a boost pump for supplying pressurized fluid to a third fluid flow line at a pressure normally less than the pressure at which fluid is supplied to the first and second fluid flow lines by the bi-directional pump, and wherein the boost pump is a submersible pump submersed in a reservoir for the fluid.

* * * * *